US009842603B2

(12) United States Patent
Yamamoto et al.

(10) Patent No.: US 9,842,603 B2
(45) Date of Patent: Dec. 12, 2017

(54) ENCODING DEVICE AND ENCODING METHOD, DECODING DEVICE AND DECODING METHOD, AND PROGRAM

(75) Inventors: Yuki Yamamoto, Tokyo (JP); Toru Chinen, Kanagawa (JP)

(73) Assignee: Sony Corporation, Tokyo (JP)

( * ) Notice: Subject to any disclaimer, the term of this patent is extended or adjusted under 35 U.S.C. 154(b) by 147 days.

(21) Appl. No.: 14/236,350

(22) PCT Filed: Aug. 14, 2012

(86) PCT No.: PCT/JP2012/070683

§ 371 (c)(1),
(2), (4) Date: Jan. 31, 2014

(87) PCT Pub. No.: WO2013/027630

PCT Pub. Date: Feb. 28, 2013

(65) Prior Publication Data

US 2014/0200899 A1 Jul. 17, 2014

(30) Foreign Application Priority Data

Aug. 24, 2011 (JP) ..... 2011-182449

(51) Int. Cl.
*G10L 19/00* (2013.01)
*G10L 19/26* (2013.01)
(Continued)

(52) U.S. Cl.
CPC ..... *G10L 19/265* (2013.01); *G10L 19/022* (2013.01); *G10L 21/038* (2013.01); *G10L 19/0204* (2013.01); *G10L 25/21* (2013.01)

(58) Field of Classification Search
None
See application file for complete search history.

(56) References Cited

U.S. PATENT DOCUMENTS 8,144,804 B2 3/2012 Chinen et al.
8,332,210 B2 12/2012 Nilsson et al.
(Continued)

FOREIGN PATENT DOCUMENTS

CA 2775387 A1 4/2011
EP 2317509 A1 5/2011
(Continued)

OTHER PUBLICATIONS

Chinen et al., Report on PVC CE for SBR in USAC, Motion Picture Expert Group Meeting, Oct. 28, 2010, ISO/IEC JTC1/SC29/WG11, No. M18399, 47 pages.*
(Continued)

*Primary Examiner* — Richa Mishra
(74) *Attorney, Agent, or Firm* — Wolf, Greenfield & Sacks, P.C.

(57) ABSTRACT

The present technology relates to an encoding device and an encoding method, a decoding device and a decoding method, and a program, configured to obtain a high quality audio with less encoding amount. A number-of-sections determining feature amount calculating circuit calculates a number-of-sections determining feature amount for determining the number of divisions to divide a process target section into continuous frame sections each including a frame for which the same estimation coefficient is selected, based on sub-band signals of a plurality of sub-bands constituting an input signal. A quasi-high frequency sub-band power difference calculating circuit determines the number of continuous frame sections in the process target section based on the number-of-sections determining feature amount, selects an estimation coefficient for obtaining a high frequency component of the input signal by estimation for each continuous frame section, and generates data including a coefficient index for obtaining the estimation coefficient. A
(Continued)

high frequency encoding circuit encodes the obtained data, and generates high frequency encoded data. The present technology can be applied to an encoding device.

18 Claims, 14 Drawing Sheets

(51) Int. Cl.

| | |
|---|---|
| ***G10L 19/022*** | (2013.01) |
| ***G10L 21/038*** | (2013.01) |
| *G10L 25/21* | (2013.01) |
| *G10L 19/02* | (2013.01) |

(56) References Cited

U.S. PATENT DOCUMENTS

| | | | | |
|---|---|---|---|---|
| 8,340,213 | B2 | 12/2012 | Chinen et al. | |
| 8,386,243 | B2 | 2/2013 | Nilsson et al. | |
| 8,498,344 | B2 | 7/2013 | Wilson et al. | |
| 8,560,330 | B2 | 10/2013 | Gao | |
| 8,949,119 | B2 | 2/2015 | Yamamoto et al. | |
| 8,972,248 | B2 | 3/2015 | Otani et al. | |
| 9,047,875 | B2 | 6/2015 | Gao | |
| 9,177,563 | B2 | 11/2015 | Yamamoto et al. | |
| 9,208,795 | B2 | 12/2015 | Yamamoto et al. | |
| 9,294,062 | B2 | 3/2016 | Hatanaka et al. | |
| 9,361,900 | B2 | 6/2016 | Yamamoto et al. | |
| 9,390,717 | B2 | 7/2016 | Yamamoto et al. | |
| 9,406,306 | B2 | 8/2016 | Yamamoto et al. | |
| 9,406,312 | B2 | 8/2016 | Yamamoto et al. | |
| 9,437,197 | B2 | 9/2016 | Honma et al. | |
| 9,437,198 | B2 | 9/2016 | Hatanaka et al. | |
| 9,536,542 | B2 | 1/2017 | Yamamoto et al. | |
| 9,583,112 | B2 | 2/2017 | Yamamoto et al. | |
| 9,659,573 | B2 | 5/2017 | Yamamoto et al. | |
| 9,679,580 | B2 | 6/2017 | Yamamoto et al. | |
| 2007/0040709 | A1 | 2/2007 | Sung et al. | |
| 2008/0270125 | A1 | 10/2008 | Choo et al. | |
| 2011/0137659 | A1 | 6/2011 | Honma et al. | |
| 2012/0243526 | A1 | 9/2012 | Yamamoto et al. | |
| 2013/0028427 | A1 | 1/2013 | Yamamoto et al. | |
| 2013/0030818 | A1 | 1/2013 | Yamamoto et al. | |
| 2013/0124214 | A1 | 5/2013 | Yamamoto et al. | |
| 2013/0202118 | A1 | 8/2013 | Yamamoto et al. | |
| 2013/0208902 | A1 | 8/2013 | Yamamoto et al. | |
| 2013/0275142 | A1 | 10/2013 | Hatanaka et al. | |
| 2014/0006037 | A1 | 1/2014 | Honma et al. | |
| 2014/0046658 | A1* | 2/2014 | Grancharov | G10L 19/02 704/208 |
| 2014/0172433 | A2 | 6/2014 | Honma et al. | |
| 2014/0180682 | A1 | 6/2014 | Shi et al. | |
| 2014/0200900 | A1 | 7/2014 | Yamamoto et al. | |
| 2014/0205101 | A1 | 7/2014 | Yamamoto et al. | |
| 2014/0205111 | A1 | 7/2014 | Hatanaka et al. | |
| 2014/0211948 | A1 | 7/2014 | Hatanaka et al. | |
| 2014/0214432 | A1 | 7/2014 | Hatanaka et al. | |
| 2015/0051904 | A1 | 2/2015 | Kikuiri et al. | |
| 2015/0088528 | A1 | 3/2015 | Toguri et al. | |
| 2015/0120307 | A1 | 4/2015 | Yamamoto et al. | |
| 2016/0012829 | A1 | 1/2016 | Yamamoto et al. | |
| 2016/0019911 | A1 | 1/2016 | Yamamoto et al. | |
| 2016/0140982 | A1 | 5/2016 | Yamamoto et al. | |
| 2016/0322057 | A1 | 11/2016 | Yamamoto et al. | |
| 2017/0076737 | A1 | 3/2017 | Yamamoto et al. | |
| 2017/0148452 | A1 | 5/2017 | Hatanaka et al. | |

FOREIGN PATENT DOCUMENTS

| | | | | |
|---|---|---|---|---|
| JP | 2001-521648 | | 11/2001 | |
| JP | 2007-178529 | A | 7/2007 | |
| JP | 2007-333785 | | 12/2007 | |
| JP | 2008-139844 | | 6/2008 | |
| JP | 2010-020251 | | 1/2010 | |
| JP | 2010-079275 | | 4/2010 | |
| JP | 2010-526331 | A | 7/2010 | |
| JP | CA 2775387 | A1 * | 4/2011 | G10L 21/038 |
| WO | WO 2005/111568 | | 11/2005 | |
| WO | WO 2006/049205 | | 5/2006 | |
| WO | WO 2011/043227 | | 4/2011 | |

OTHER PUBLICATIONS

U.S. Appl. No. 15/003,960, filed Jan. 22, 2016, Yamamoto et al.
U.S. Appl. No. 13/978,175, filed Jul. 3, 2013, Hatanaka et al.
U.S. Appl. No. 14/104,828, filed Dec. 12, 2013, Shi et al.
U.S. Appl. No. 14/238,243, filed Feb. 11, 2014, Hatanaka et al.
U.S. Appl. No. 14/239,574, filed Feb. 19, 2014, Hatanaka et al.
U.S. Appl. No. 14/239,797, filed Feb. 20, 2014, Hatanaka et al.
U.S. Appl. No. 14/390,810, filed Oct. 6, 2014, Toguri et al.
U.S. Appl. No. 15/206,783, filed Jul. 11, 2016, Yamamoto et al.
U.S. Appl. No. 15/357,877, filed Nov. 21, 2016, Yamamoto et al.
U.S. Appl. No. 14/006,148, filed Sep. 19, 2013, Honma et al.
U.S. Appl. No. 14/237,993, filed Feb. 10, 2014, Yamamoto et al.
U.S. Appl. No. 13/640,500, filed Apr. 19, 2013, Yamamoto et al.
U.S. Appl. No. 13/639,325, filed Oct. 4, 2012, Yamamoto et al.
U.S. Appl. No. 13/499,559, filed Jun. 11, 2012, Yamamoto et al.
U.S. Appl. No. 13/639,338, filed Oct. 4, 2012, Yamamoto et al.
U.S. Appl. No. 14/585,974, filed Dec. 30, 2014, Yamamoto et al.
U.S. Appl. No. 14/870,268, filed Sep. 30, 2015, Yamamoto et al.
U.S. Appl. No. 13/498,234, filed Apr. 12, 2012, Yamamoto et al.
U.S. Appl. No. 13/877,192, filed Apr. 1, 2013, Yamamoto et al.
U.S. Appl. No. 14/861,734, filed Sep. 22, 2015, Yamamoto et al.

* cited by examiner

ENCODING DEVICE AND ENCODING METHOD, DECODING DEVICE AND DECODING METHOD, AND PROGRAM

TECHNICAL FIELD

The present technology relates to an encoding device and an encoding method, a decoding device and a decoding method, and a program, and more particularly, to an encoding device and an encoding method, a decoding device and a decoding method, and a program, configured to obtain a high quality audio with less encoding amount.

BACKGROUND ART

A method of encoding an audio signal includes HE-AAC (High Efficiency MPEG (Moving Picture Experts Group) 4 AAC (Advanced Audio Coding)) (ISO Standards/IEC 14496-3), AAC (MPEG2 AAC) (ISO Standards/IEC 13818-7), and the like.

For example, as the method of encoding the audio signal, a method has been proposed, in which low frequency encoding information obtained by encoding a low frequency component and high frequency encoding information for obtaining an estimated value of a high frequency component, which is generated from the low frequency component and the high frequency component, are output as a code obtained by encoding the audio signal (see, for example, Patent Document 1). In this method, the high frequency encoding information contains information required to calculate the estimated value of the high frequency component, such as a scale factor, an amplitude adjustment coefficient, and a spectral residual, for obtaining the high frequency component.

When decoding the code, the low frequency component obtained by decoding the low frequency encoding information and the high frequency component obtained by estimating the high frequency component based on information obtained by decoding the high frequency encoding information are combined to reproduce the audio signal.

In this type of encoding method, only the information for obtaining the estimated value of the high frequency component is encoded as information on a high frequency signal component, and hence the encoding efficiency can be improved while suppressing degradation of the sound quality.

CITATION LIST

Patent Documents

Patent Document 1: WO 2006/049205 A

SUMMARY OF THE INVENTION

Problems to be Solved by the Invention

However, in the above-mentioned technology, although the high quality audio can be obtained as a result of decoding the code, the information for calculating the estimated value of the high frequency component should be generated for each processing unit of the audio signal, which is far from certain on that an encoding amount of the high frequency encoding information is sufficiently small.

The present technology has been achieved in view of the above aspects, to enable the high quality audio to be obtained with less encoding amount.

Solutions to Problems

An encoding device according to a first aspect of the present technology includes a sub-band dividing unit configured to generate a low frequency sub-band signal of a sub-band on a low frequency side of an input signal and a high frequency sub-band signal of a sub-band on a high frequency side of the input signal, a quasi-high frequency sub-band power calculating unit configured to calculate a quasi-high frequency sub-band power that is an estimated value of a high frequency sub-band power of the high frequency sub-band signal based on the low frequency sub-band signal and a predetermined estimation coefficient, a feature amount calculating unit configured to calculate a number-of-sections determining feature amount based on at least one of the low frequency sub-band signal or the high frequency sub-band signal, a determining unit configured to determine the number of continuous frame sections including frames for which the same estimation coefficient is selected in a process target section including a plurality of frames of the input signal, based on the number-of-sections determining feature amount, a selecting unit configured to select the estimation coefficient of a frame that constitutes the continuous frame section from a plurality of estimation coefficients based on the quasi-high frequency sub-band power and the high frequency sub-band power in each continuous frame section obtained by dividing the process target section based on the determined number of continuous frame sections, a generating unit configured to generate data for obtaining the estimation coefficient selected in a frame of each of the continuous frame sections constituting the process target section, a low frequency encoding unit configured to encode a low frequency signal of the input signal to generate low frequency encoded data, and a multiplexing unit configured to multiplex the data and the low frequency encoded data to generate an output code string.

The number-of-sections determining feature amount can be defined as a feature amount indicating a sum of the high frequency sub-band power.

The number-of-sections determining feature amount can be defined as a feature amount indicating a temporal change of a sum of the high frequency sub-band power.

The number-of-sections determining feature amount can be defined as a feature amount indicating a frequency profile of the input signal.

The number-of-sections determining feature amount can be defined as a linear sum or a nonlinear sum of a plurality of feature amounts.

The encoding device further includes an evaluation value sum calculating unit configured to calculate, based on an evaluation value indicating an error between the quasi-high frequency sub-band power and the high frequency sub-band power in the frame calculated for each of the estimation coefficients, a sum of the evaluation value of each frame constituting the continuous frame section for each of the estimation coefficients. The selecting unit can select the estimation coefficient of the frame of the continuous frame section based on the sum of the evaluation value calculated for each of the estimation coefficients.

Each section obtained by equally dividing the process target section by the determined number of continuous frame sections can be defined as the continuous frame section.

The selecting unit can select the estimation coefficient of the frame of the continuous frame section based on the sum of the evaluation value for each combination of divisions of the process target section that can be taken when dividing the process target section by the determined number of continuous frame sections, identify a combination with which the sum of the evaluation values of the selected estimation coefficients of all the frames constituting the process target section is minimized from among the combinations, and define the estimation coefficient selected in each frame as the estimation coefficient of the corresponding frame in the identified combination.

The encoding device further includes a high frequency encoding unit configured to encode the data to generate high frequency encoded data. The multiplexing unit can generate the output code string by multiplexing the high frequency encoded data and the low frequency encoded data.

The determining unit can further calculate an encoding amount of the high frequency encoded data of the process target section based on the determined number of continuous frame sections, and the low frequency encoding unit can encode the low frequency signal at the encoding amount determined from an encoding amount determined in advance for the process target section and the calculated encoding amount of the high frequency encoded data.

An encoding method or a program according to the first aspect of the present technology includes the steps of generating a low frequency sub-band signal of a sub-band on a low frequency side of an input signal and a high frequency sub-band signal of a sub-band on a high frequency side of the input signal, calculating a quasi-high frequency sub-band power that is an estimated value of a high frequency sub-band power of the high frequency sub-band signal based on the low frequency sub-band signal and a predetermined estimation coefficient, calculating a number-of-sections determining feature amount based on at least one of the low frequency sub-band signal or the high frequency sub-band signal, determining the number of continuous frame sections including frames for which the same estimation coefficient is selected in a process target section including a plurality of frames of the input signal, based on the number-of-sections determining feature amount, selecting the estimation coefficient of a frame that constitutes the continuous frame section from a plurality of estimation coefficients based on the quasi-high frequency sub-band power and the high frequency sub-band power in each continuous frame section obtained by dividing the process target section based on the determined number of continuous frame sections, generating data for obtaining the estimation coefficient selected in a frame of each of the continuous frame sections constituting the process target section, generating low frequency encoded data by encoding a low frequency signal of the input signal, and generating an output code string by multiplexing the data and the low frequency encoded data.

According to the first aspect of the present technology, a low frequency sub-band signal of a sub-band on a low frequency side of an input signal and a high frequency sub-band signal of a sub-band on a high frequency side of the input signal are generated, a quasi-high frequency sub-band power that is an estimated value of a high frequency sub-band power of the high frequency sub-band signal is calculated based on the low frequency sub-band signal and a predetermined estimation coefficient, a number-of-sections determining feature amount is calculated based on at least one of the low frequency sub-band signal or the high frequency sub-band signal, the number of continuous frame sections including frames for which the same estimation coefficient is selected in a process target section including a plurality of frames of the input signal is determined based on the number-of-sections determining feature amount, the estimation coefficient of a frame that constitutes the continuous frame section is selected from a plurality of estimation coefficients based on the quasi-high frequency sub-band power and the high frequency sub-band power in each continuous frame section obtained by dividing the process target section based on the determined number of continuous frame sections, data for obtaining the estimation coefficient selected in a frame of each of the continuous frame sections constituting the process target section is generated, low frequency encoded data is generated by encoding the low frequency signal of the input signal, and an output code string is generated by multiplexing the data and the low frequency encoded data.

A decoding device according to a second aspect of the present technology includes a demultiplexing unit configured to demultiplex an input code string into data for obtaining an estimation coefficient selected in a frame of each continuous frame section constituting a process target section, which is generated based on a result of calculating an estimated value of a high frequency sub-band power of a high frequency sub-band signal of an input signal based on a low frequency sub-band signal of the input signal and a predetermined estimation coefficient, determining the number of continuous frame sections including frames for which the same estimation coefficient is selected in the process target section including a plurality of frames of the input signal based on a number-of-sections determining feature amount extracted from the input signal, and selecting the estimation coefficient of a frame constituting the continuous frame section from a plurality of estimation coefficients based on the estimated value and the high frequency sub-band power in each of the continuous frame sections obtained by dividing the process target section based on the determined number of continuous frame sections, and low frequency encoded data obtained by encoding a low frequency signal of the input signal, a low frequency decoding unit configured to decode the low frequency encoded data to generate a low frequency signal, a high frequency signal generating unit configured to generate a high frequency signal based on the estimation coefficient obtained from the data and the low frequency signal obtained from the decoding, and a combining unit configured to generate an output signal based on the high frequency signal and the low frequency signal obtained from the decoding.

The decoding device further includes a high frequency decoding unit configured to decode the data to obtain the estimation coefficient.

Based on an evaluation value indicating an error between the estimated value and the high frequency sub-band power in the frame calculated for each of the estimation coefficients, a sum of the evaluation value of each frame constituting the continuous frame section can be calculated for each of the estimation coefficients, and based on the sum of the evaluation value calculated for each of the estimation coefficients, the estimation coefficient of the frame of the continuous frame section can be selected.

Each section obtained by equally dividing the process target section by the determined number of continuous frame sections can be defined as the continuous frame section.

The estimation coefficient of the frame of the continuous frame section can be selected based on the sum of the evaluation value for each combination of divisions of the process target section that can be taken when dividing the process target section by the determined number of continuous frame sections, a combination with which the sum of the evaluation values of the selected estimation coefficients of all the frames constituting the process target section is minimized can be identified from among the combinations, and the estimation coefficient selected in each frame can be defined as the estimation coefficient of the corresponding frame in the identified combination.

A decoding method or a program according to the second aspect of the present technology includes the steps of demultiplexing an input code string into data for obtaining an estimation coefficient selected in a frame of each continuous frame section constituting a process target section, which is generated based on a result of calculating an estimated value of a high frequency sub-band power of a high frequency sub-band signal of an input signal based on a low frequency sub-band signal of the input signal and a predetermined estimation coefficient, determining the number of continuous frame sections including frames for which the same estimation coefficient is selected in the process target section including a plurality of frames of the input signal based on a number-of-sections determining feature amount extracted from the input signal, and selecting the estimation coefficient of a frame constituting the continuous frame section from a plurality of estimation coefficients based on the estimated value and the high frequency sub-band power in each of the continuous frame sections obtained by dividing the process target section based on the determined number of continuous frame sections, and low frequency encoded data obtained by encoding a low frequency signal of the input signal, generating a low frequency signal by decoding the low frequency encoded data, generating a high frequency signal based on the estimation coefficient obtained from the data and the low frequency signal obtained from the decoding, and generating an output signal based on the high frequency signal and the low frequency signal obtained from the decoding.

According to the second aspect of the present technology, an input code string is demultiplexed into data for obtaining an estimation coefficient selected in a frame of each continuous frame section constituting a process target section, which is generated based on a result of calculating an estimated value of a high frequency sub-band power of a high frequency sub-band signal of an input signal based on a low frequency sub-band signal of the input signal and a predetermined estimation coefficient, determining the number of continuous frame sections including frames for which the same estimation coefficient is selected in the process target section including a plurality of frames of the input signal based on a number-of-sections determining feature amount extracted from the input signal, and selecting the estimation coefficient of a frame constituting the continuous frame section from a plurality of estimation coefficients based on the estimated value and the high frequency sub-band power in each of the continuous frame sections obtained by dividing the process target section based on the determined number of continuous frame sections, and low frequency encoded data obtained by encoding a low frequency signal of the input signal, a low frequency signal is generated by decoding the low frequency encoded data, a high frequency signal is generated based on the estimation coefficient obtained from the data and the low frequency signal obtained from the decoding, and an output signal is generated based on the high frequency signal and the low frequency signal obtained from the decoding.

Effects of the Invention

According to the first and second aspects of the present technology, a high quality audio can be obtained with less encoding amount.

MODES FOR CARRYING OUT THE INVENTION

Exemplary embodiments of the present technology are described in detail below with reference to the accompanying drawings.

<Outline of the Present Technology>

[On Encoding of an Input Signal]

The present technology is to perform an encoding of an input signal by receiving, for example, an audio signal such as a music signal as the input signal.

Figure 1:
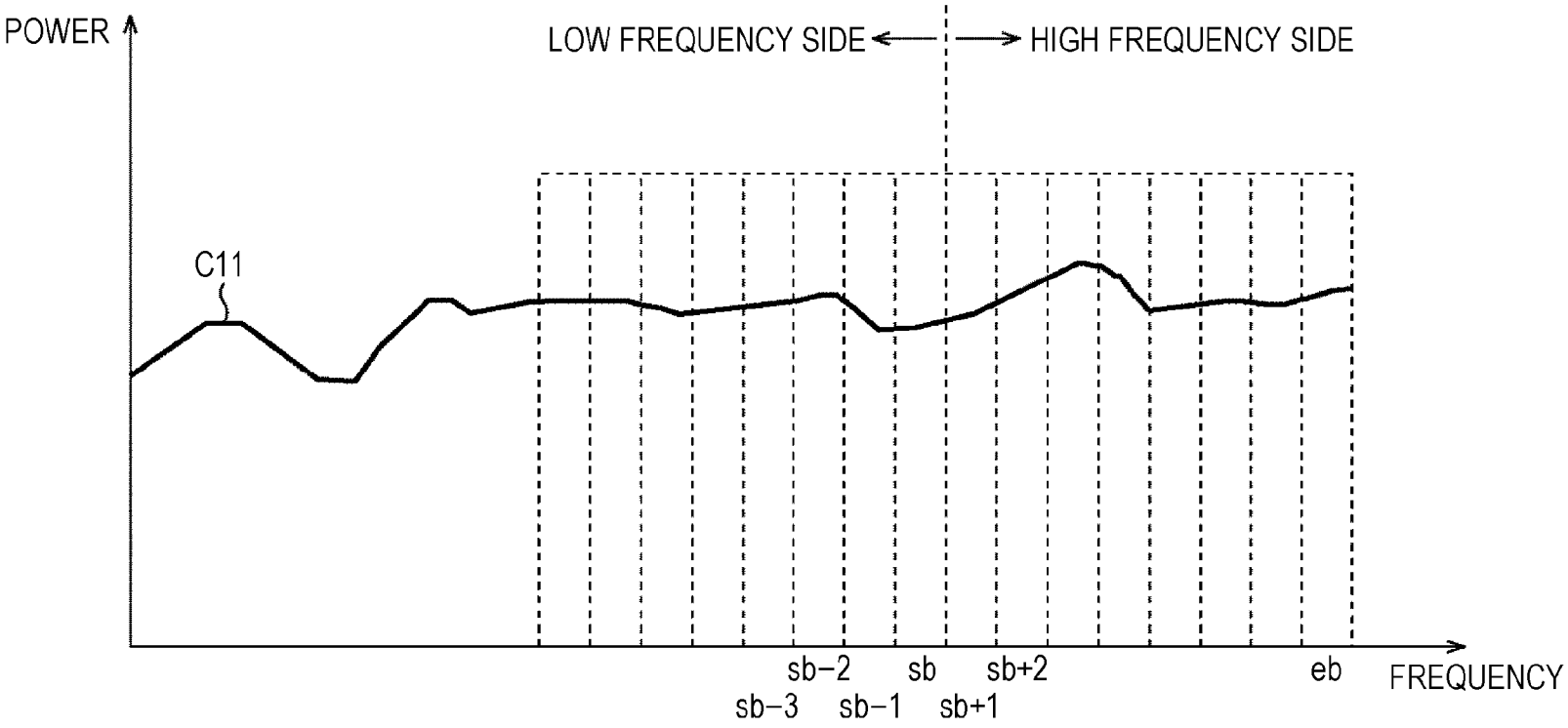
FIG. 1 is a schematic diagram illustrating a sub-band of an input signal.

In an encoding device that performs encoding of an input signal, as illustrated in FIG. 1, the input signal is divided into sub-band signals of a plurality of frequency bands (hereinafter, a "sub-band") each having a predetermined bandwidth at the time of encoding. In FIG. 1, the vertical axis represents power of each frequency of the input signal, and the horizontal axis represents frequency of the input signal. In the drawing, a curved line C11 indicates the power of each frequency component of the input signal, and a dashed line in the vertical direction indicates a boundary position of each sub-band.

When the input signal is divided into the sub-band signals of the sub-bands, a component on a low frequency side equal to or lower than a preset frequency among frequency components of the input signal is encoded by a predetermined encoding system, to generate low frequency encoded data.

In the example illustrated in FIG. 1, the sub-band having a frequency equal to or lower than an upper-limit frequency of a sub-band sb having an index sb for identifying each sub-band is defined as a low frequency component of the input signal, and a sub-band having a frequency higher than the upper limit frequency of the sub-band sb is defined as a high frequency component of the input signal.

When the low frequency encoded data is obtained, information for reproducing a sub-band signal of each sub-band of the high frequency component is generated based on the low frequency component and the high frequency component of the input signal, and the information is encoded by a predetermined encoding system in an appropriate manner to generate high frequency encoded data.

Specifically, the high frequency encoded data is generated from components of four sub-bands including sub-band sb−3 to sub-band sb having the highest frequencies on the low frequency side and arranged continuously in a frequency direction and components of (eb−(sb+1)+1) sub-bands including sub-band sb+1 to sub-band eb arranged continuously on the high frequency side.

The sub-band sb+1 is a high frequency sub-band located on the most low frequency side, which is adjacent to the sub-band sb, and the sub-band eb is a sub-band having the highest frequency among the sub-band sb+1 to the sub-band eb that are continuously arranged.

The high frequency encoded data obtained by encoding the high frequency component is information for generating a sub-band signal of a sub-band ib (where sb+1≤ib≤eb) on the high frequency side by an estimation, and the high frequency encoded data includes a coefficient index for obtaining an estimation coefficient used to estimate each sub-band signal.

That is, in the estimation of the sub-band signal of a sub-band ib, a coefficient $A_{ib}(kb)$ multiplied by the power of the sub-band of each sub-band kb (where sb−3≤kb≤sb) on the low frequency side and an estimation coefficient including a coefficient $B_{ib}$ that is a constant term are employed. The coefficient index included in the high frequency encoded data is information for obtaining a set of the estimation coefficients including the coefficient $A_{ib}(kb)$ of each sub-band ib and the coefficient $B_{ib}$, for example, information for identifying a set of the estimation coefficients.

When the low frequency encoded data and the high frequency encoded data are obtained in the above manner, the low frequency encoded data and the high frequency encoded data are multiplexed to generate an output code string, which is then output.

In this manner, by including the coefficient index for obtaining the estimation coefficient in the high frequency encoded data, compared to a case where a scale factor, an amplitude adjustment coefficient, or the like is included to calculate the high frequency component for each frame, the encoding amount of the high frequency encoded data can be greatly reduced.

Further, a decoding device that receives the output code string obtains a decoded low frequency signal including the sub-band signal of each sub-band on the low frequency side by decoding the low frequency encoded data, and generates the sub-band signal of each sub-band on the high frequency side by an estimation from the decoded low frequency signal and information obtained by decoding the high frequency encoded data. The output signal obtained in this manner is a signal obtained by decoding the encoded input signal.

[On Output Code String]

An appropriate estimation coefficient is selected for a frame to be processed from among a plurality of estimation coefficients prepared in advance for each section of the input signal corresponding to a predetermined time length, i.e., for each frame, in the encoding of the input signal.

In the encoding device, further reduction of the encoding amount is achieved by including time information for which the coefficient index is changed in a time direction and a value of the changed coefficient index in the high frequency encoded data, without including the coefficient index of each frame as it is in the high frequency encoded data.

In particular, when the input signal is a steady-state signal with no change of each frequency component in the time direction, the selected estimation coefficient, i.e., the coefficient index of the same often continues in a row in the time direction. Therefore, in order to reduce information amount of the coefficient index included in the high frequency encoded data in the time direction, a variable-length system and a fixed-length system are appropriately switched when performing the encoding of the higher frequency component of the input signal.

[On Variable-Length System]

Encodings of the high frequency component by the variable-length system and the fixed-length system are described below.

When encoding the high frequency component, switching is performed between the variable-length system and the fixed-length system for a section of a predetermined frame length that is determined in advance. For example, in the following descriptions, the switching is performed between the variable-length system and the fixed-length system for every 16 frames, and a section of the 16 frames of the input signal may be referred to as a process target section. That is, in the encoding device, the output code string is output in units of 16 frames that is the process target section.

Firstly, the variable-length system is described. In the encoding of the high frequency component by the variable-length system, data including a system flag, a coefficient index, section information, and number information is encoded and output as the high frequency encoded data.

The system flag is information indicating a system for generating the high frequency encoded data, i.e., information indicating which system is selected between the variable-length system and the fixed-length system at the time of encoding the high frequency component.

The section information is information indicating a length of a section including continuous frames included in the process target section and for which the same coefficient index is selected (hereinafter, a "continuous frame section"). The number information is information indicating the number of continuous frame sections included in the process target section.

Figure 2:
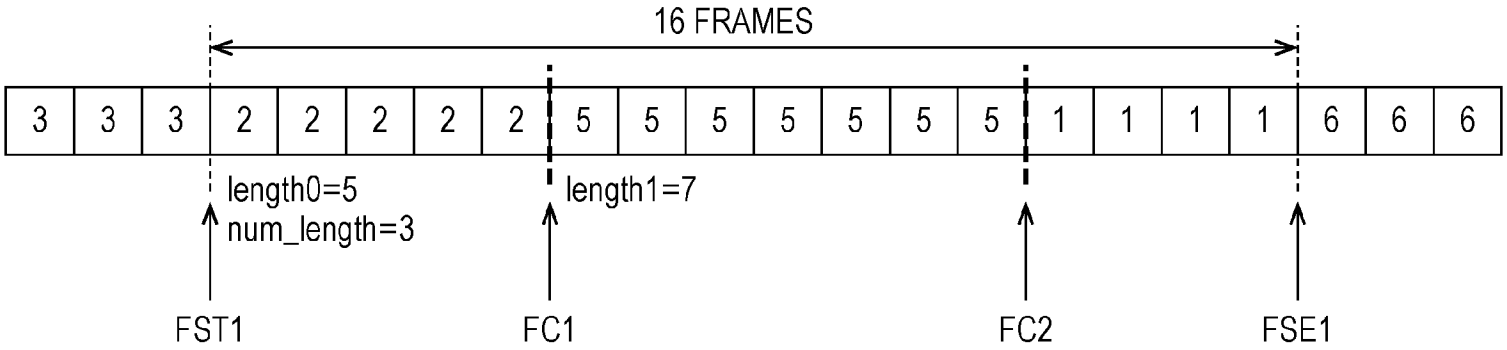
FIG. 2 is a schematic diagram illustrating an encoding of a high frequency component by a variable-length system.

For example, in the variable-length system, as illustrated in FIG. 2, a section of 16 frames from a position FST1 to a position FSE1 is defined as one process target section. In FIG. 2, the horizontal direction represents time, and one square represents one frame. Further, the numerical value in a square indicating a frame indicates a value of a coefficient index for identifying the estimation coefficient selected for the frame.

In the encoding of the high frequency component by the variable-length system, firstly, the process target section is divided into continuous frame sections each including continuous frames for which the same coefficient index is selected. That is, a boundary position between frames adjacent to each other for which different coefficient indexes are respectively selected is defined as a boundary position between the continuous frame sections.

In this example, the process target section is divided into three sections including a section from the position FST1 to the position FC1, a section from the position FC1 to the position FC2, and a section from the position FC2 to the position FSE1. For example, in the continuous frame section from the position FST1 to the position FC1, the same coefficient index "2" is selected in each of the frames.

When the process target section is divided into continuous frame sections in the above manner, the data including the number information indicating the number of continuous frame sections, the coefficient index selected in each of the continuous frame sections, the section information indicating the length of each of the continuous frame sections, and the system flag in the process target section is generated.

In this case, the process target section is divided into three continuous frame sections, information indicating the number of continuous frame sections "3" is defined as the number information. In FIG. 2, the number information is represented as "num_length=3".

For example, the section information of the first continuous frame section in the process target section is represented as length "5" with units of frame in the continuous frame section, and is represented as "length0=5" in FIG. 2. Further, each piece of section information is configured to identify the order of the continuous frame section from the head of the process target section. In other words, in the section information, information for identifying a position of the continuous frame section in the process target section is also included.

When the data including the number information, the coefficient index, the section information, and the system flag for the process target section is generated, this data is encoded and output as the high frequency encoded data. In this case, when the same coefficient index is selected continuously for a plurality of frames, the coefficient index does not need to be transmitted for each frame, the data amount of the output code string to be transferred is reduced, and as a result, the encoding and the decoding can be performed more efficiently.

[On Fixed-Length System]

The encoding of the high frequency component by the fixed-length system is described below.

Figure 3:
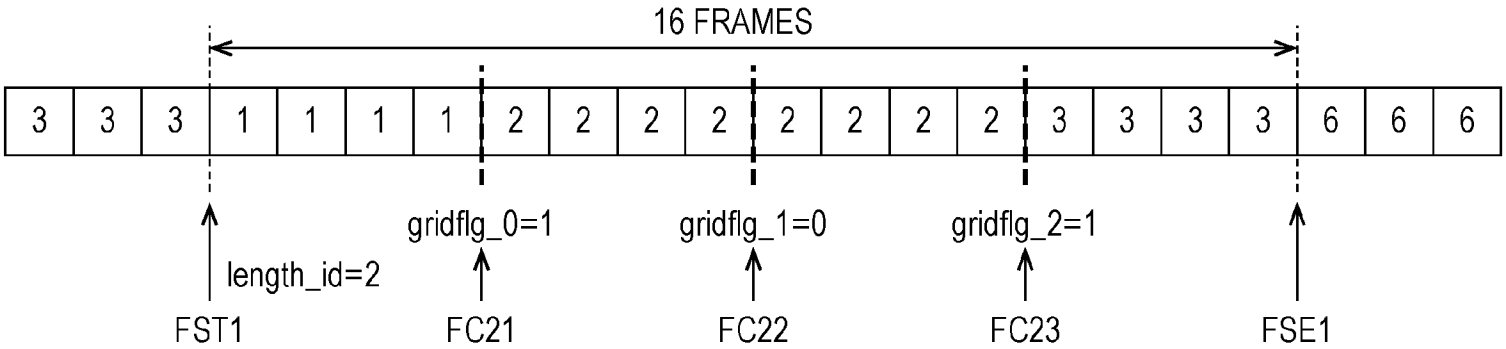
FIG. 3 is a schematic diagram illustrating an encoding of a high frequency component by a fixed-length system.

In the fixed-length system, as illustrated in FIG. 3, a process target section including 16 frames is equally divided into sections having a predetermined number of frames (hereinafter, a "fixed-length section"). In FIG. 3, the horizontal direction represents time, and one square represents one frame. Further, the numerical value in a square indicating a frame indicates a value of a coefficient index for identifying the estimation coefficient selected for the frame. Further, in FIG. 3, the same reference sign is assigned to a portion corresponding to that illustrated in FIG. 2, and the description thereof is omitted.

In the fixed-length system, the process target section is divided into a plurality of fixed-length sections. In this case, a length of the fixed-length section is determined such that the coefficient index selected in each of the frames in the fixed-length section is the same and the length of the fixed-length section is maximized.

In the example illustrated in FIG. 3, the length of the fixed-length section (hereinafter, simply a "fixed length") is 4 frames, and the process target section is equally divided into four fixed-length sections. That is, the process target section is divided into a section from a position FST1 to a position FC21, a section from a position FC21 to a position FC22, a section from a position FC22 to a position FC23, and a section from a position FC23 to a position FSE1. The coefficient indexes in these fixed-length sections are represented as "1", "2", "2", and "3" in order from the fixed-length section at the head of the process target section.

When the process target section is divided into a plurality of fixed-length sections in the above manner, data including a fixed length index indicating the fixed length of the fixed-length section, a coefficient index, a switch flag, and a system flag in the process target section is generated.

The switch flag is information indicating a boundary position between the fixed-length sections, i.e., whether or not the coefficient index is changed between the last frame of a predetermined fixed-length section and the first frame of a fixed-length section next to the predetermined fixed-length section. For example, a switch flag gridflg_i of i-th (i=0, 1, 2, . . . ) is set to "1" when the coefficient index is changed at a boundary position between (i+1)-th fixed-length section and (i+2)-th fixed-length section from the head of the process target section and set to "0" when the coefficient index is not changed.

In the example illustrated in FIG. 3, the switch flag gridflg_0 at the boundary position (position FC21) of the first fixed-length section of the process target section is set to "1" because the coefficient index "1" of the first fixed-length section is different from the coefficient index "2" of the second fixed-length section. Further, the switch flag gridflg_1 at the position FC22 is set to "0" because the coefficient index "2" of the second fixed-length section is the same as the coefficient index "2" of the third fixed-length section.

Further, a value of the fixed length index is set to a value obtained from the fixed length. Specifically, for example, the fixed length index length_id is set to a value that satisfies the fixed length fixed length=$16/2^{length}$_id. In the example illustrated in FIG. 3, because the fixed length fixed_length=4, the fixed length index length_id=2.

When the process target section is divided into the fixed-length sections and the data including the fixed length index, the coefficient index, the switch flag, and the system flag is generated, this data is encoded and output as the high frequency encoded data.

In the example illustrated in FIG. 3, the data including the switch flags gridflg_0=1, gridflg_1=0, and gridflg_2=1 at the position FC21 to the position FC23, the fixed length index length_id=2, the coefficient indexes "1", "2", and "3" of the fixed-length sections, and the system flag indicating the fixed-length system is encoded and output as the high frequency encoded data.

The switch flag at the boundary position between the fixed-length sections is configured to identify the order of the switch flag at the boundary position from the head of the process target section. In other words, in the switch flag, information for identifying the boundary position of the fixed-length section in the process target section is included.

Further, the coefficient indexes included in the high frequency encoded data are arranged in the order in which the coefficient indexes are selected, i.e., the order in which the fixed-length sections are arranged. For example, in the example illustrated in FIG. 3, the fixed-length sections are arranged in the order of coefficient indexes "1", "2", and "3", and these coefficient indexes are included in the data.

Although the coefficient indexes of the second fixed-length section and the third fixed-length section from the head of the process target section are "2" in the example illustrated in FIG. 3, it is configured that only one coefficient index "2" is included in the process target section. When the coefficient indexes of continuous fixed-length sections are the same, i.e., when the switch flag at the boundary position between continuous fixed-length sections is "0", only one coefficient index is included in the high frequency encoded data without including the same coefficient index for the number of corresponding fixed-length sections in the high frequency encoded data.

In this manner, when the high frequency encoded data is generated from the data including the fixed length index, the coefficient index, the switch flag, and the system flag, the coefficient index does not need to be transmitted for each of the frames, and hence the data amount of the output code string to be transferred can be reduced. As a result, the encoding and the decoding can be performed more efficiently.

[On the Number of Continuous Frame Sections]

At the time of encoding the input signal, the optimum number of continuous frame sections constituting the process target section is determined based on the sub-band signal of each sub-band of the input signal, the coefficient index (estimation coefficient) of each of the frames is selected based on the determined number of continuous frame sections. For example, the optimum number of continuous frame sections constituting the process target section is determined based on a feature amount determined from a sub-band power of a sub-band on the high frequency side (hereinafter, a "number-of-sections determining feature amount").

In this manner, by determining the number of continuous frame sections constituting the process target section based on the number-of-sections determining feature amount indicating the characteristic of the high frequency component, the coefficient index selected for each of the frames can be prevented from being changed more than necessary in the time direction.

As a result, the number of coefficient indexes included in the high frequency encoded data of the process target section and the like can be suppressed to the minimum necessary, and hence the encoding amount of the high frequency encoded data can be further reduced.

Further, as the characteristic of the high frequency component, such as an estimation error, depends on the estimation coefficient, if the coefficient index is changed more than necessary in the time direction, a temporal change of an unnatural frequency envelope, which does not exist in the input signal before the decoding, is generated in the audio signal obtained by the decoding, which acoustically degrades the sound quality. This degradation of the sound quality is conspicuous in a steady-state audio signal having less temporal change of the high frequency component.

However, if the coefficient index of each of the frames is selected after appropriately determining the number of continuous frame sections constituting the process target section, the coefficient index can be prevented from being changed more than necessary. As a result, the unnatural temporal change of the high frequency component of the audio obtained by the decoding can be suppressed, and hence the sound quality can be enhanced.

First Embodiment

[Example Structure of an Encoding Device]

Figure 4:
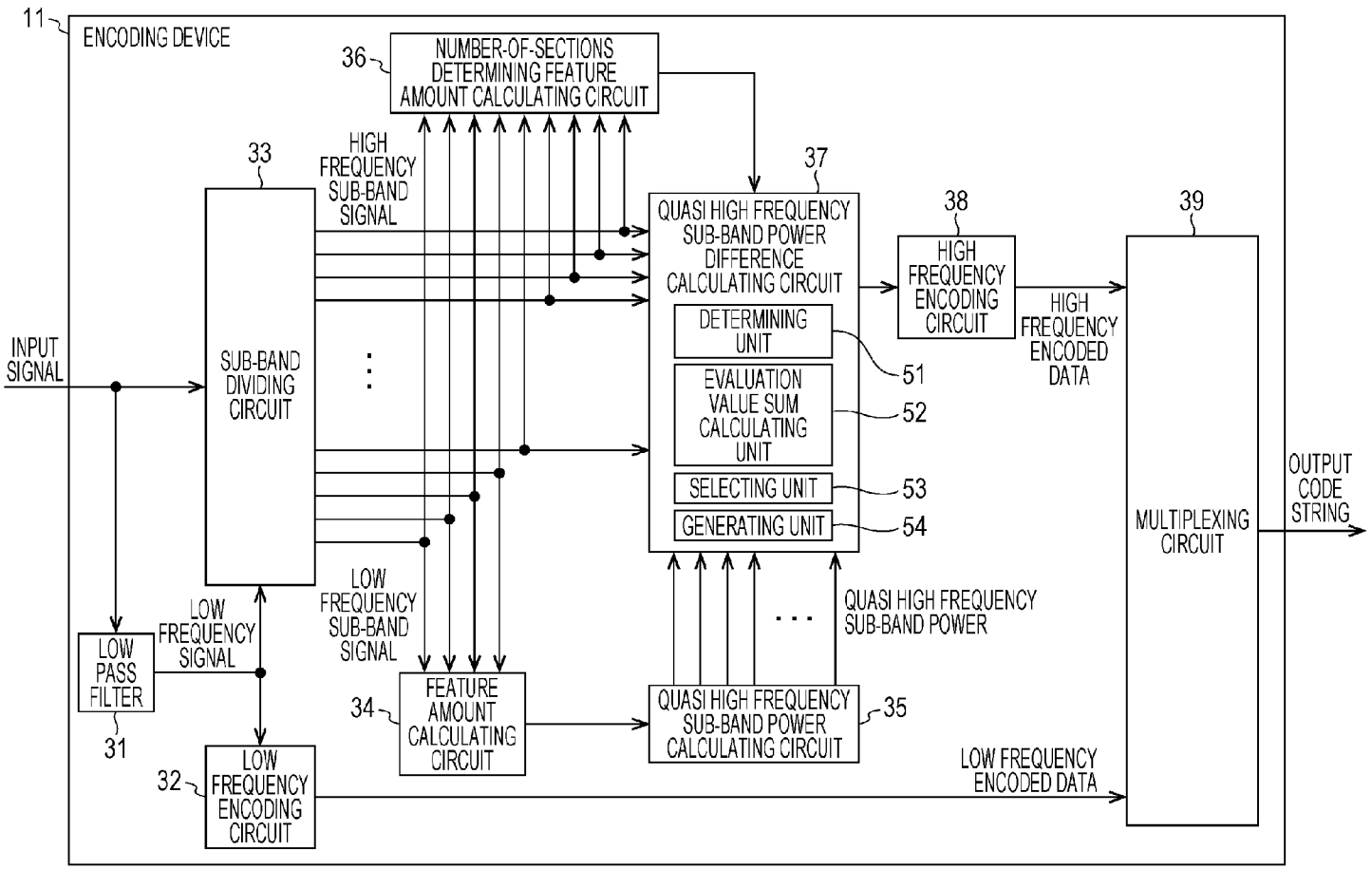
FIG. 4 is a block diagram illustrating a configuration example of an encoding device according to the present technology.

Exemplary embodiments of the encoding technology for encoding an input signal described above are described below. Firstly, a configuration of an encoding device for performing the encoding of the input signal is described. FIG. 4 is a block diagram illustrating a configuration example of the encoding device.

An encoding device 11 includes a low pass filter 31, a low frequency encoding circuit 32, a sub-band dividing circuit 33, a feature amount calculating circuit 34, a quasi-high frequency sub-band power calculating circuit 35, a number-of-sections determining feature amount calculating circuit 36, a quasi-high frequency sub-band power difference calculating circuit 37, a high frequency encoding circuit 38, and a multiplexing circuit 39. In the encoding device 11, an input signal to be encoded is supplied to the low pass filter 31 and the sub-band dividing circuit 33.

The low pass filter 31 filters the supplied input signal with a predetermined cutoff frequency, and supplies the thus-obtained signal which is on the lower frequency area than the cutoff frequency (hereinafter, a "low frequency signal") to the low frequency encoding circuit 32 and the sub-band dividing circuit 33.

The low frequency encoding circuit 32 encodes the low frequency signal supplied from the low pass filter 31, and supplies the thus-obtained low frequency encoded data to the multiplexing circuit 39.

The sub-band dividing circuit 33 equally divides the low frequency signal supplied from the low pass filter 31 into sub-band signals of a plurality of sub-bands (hereinafter, "low frequency sub-band signals"), and supplies the thus-obtained low frequency sub-band signals to the feature amount calculating circuit 34 and the number-of-sections determining feature amount calculating circuit 36. The low frequency sub-band signals are signals of the sub-bands on the low frequency side of the input signal.

Further, the sub-band dividing circuit 33 equally divides the supplied input signal into sub-band signals of a plurality of sub-bands, and supplies sub-band signals of sub-bands included in a predetermined frequency band on the high frequency side among the sub-band signals obtained by the division to the number-of-sections determining feature amount calculating circuit 36 and the quasi-high frequency sub-band power difference calculating circuit 37. Hereinafter, the sub-band signals of the sub-bands supplied from the sub-band dividing circuit 33 to the number-of-sections determining feature amount calculating circuit 36 and the quasi-high frequency sub-band power difference calculating circuit 37 are also referred to as high frequency sub-band signals.

The feature amount calculating circuit 34 calculates a feature amount based on the low frequency sub-band signal supplied from the sub-band dividing circuit 33, and supplies the calculated feature amount to the quasi-high frequency sub-band power calculating circuit 35.

The quasi-high frequency sub-band power calculating circuit 35 calculates an estimated value of a power of the high frequency sub-band signal (hereinafter, also referred to as a "quasi-high frequency sub-band power") based on the feature amount supplied from the feature amount calculating circuit 34, and supplies the calculated quasi-high frequency sub-band power to the quasi-high frequency sub-band power difference calculating circuit 37. A plurality of sets of estimation coefficients obtained by a statistical learning is recorded in the quasi-high frequency sub-band power calculating circuit 35, and the quasi-high frequency sub-band power is calculated based on the estimation coefficient and the feature amount.

The number-of-sections determining feature amount calculating circuit 36 calculates a number-of-sections determining feature amount based on the low frequency sub-band signal and the high frequency sub-band signal supplied from the sub-band dividing circuit 33, and supplies the calculated number-of-sections determining feature amount to the quasi-high frequency sub-band power difference calculating circuit 37.

The quasi-high frequency sub-band power difference calculating circuit 37 selects a coefficient index indicating an estimation coefficient suitable for estimating a high frequency component of a frame for each of the frames. The quasi-high frequency sub-band power difference calculating circuit 37 includes a determining unit 51, an evaluation value sum calculating unit 52, a selecting unit 53, and a generating unit 54.

The determining unit 51 determines the number of continuous frame sections constituting the process target section based on the number-of-sections determining feature amount supplied from the number-of-sections determining feature amount calculating circuit 36.

The quasi-high frequency sub-band power difference calculating circuit 37 calculates an evaluation value for each estimation coefficient for each of the frames based on the power of the high frequency sub-band signal supplied from the sub-band dividing circuit 33 (hereinafter, also referred to as a "high frequency sub-band power") and the quasi-high frequency sub-band power supplied from the quasi-high frequency sub-band power calculating circuit 35. This evaluation value is a value indicating an error between the actual high frequency component of the input signal and the high frequency component estimated by using the estimation coefficient.

The evaluation value sum calculating unit 52 calculates a sum of the evaluation value of continuous frames based on the number of continuous frame sections determined by the determining unit 51 and the evaluation value of each of the frames. The selecting unit 53 selects the coefficient index of each of the frames based on the sum of the evaluation value calculated by the evaluation value sum calculating unit 52.

The generating unit 54 performs switching between the variable-length system and the fixed-length system based on a selection result of the coefficient index in each of the frames of the process target section of the input signal, generates data for obtaining the high frequency encoded data by the selected system, and supplies the generated data to the high frequency encoding circuit 38.

The high frequency encoding circuit 38 encodes the data supplied from the quasi-high frequency sub-band power difference calculating circuit 37, and supplies the thus-obtained high frequency encoded data to the multiplexing circuit 39. The multiplexing circuit 39 multiplexes the low frequency encoded data from the low frequency encoding circuit 32 and the high frequency encoded data from the high frequency encoding circuit 38, and outputs the multiplexed data as an output code string.

[Description of Encoding Process]

The encoding device 11 illustrated in FIG. 4 is supplied with the input signal, performs an encoding process upon being instructed to encode the input signal, and outputs the output code string to a decoding device. The encoding process by the encoding device 11 is described below with reference to a flowchart illustrated in FIG. 5. This encoding process is performed for each preset number of frames, i.e., each process target section.

At Step S11, the low pass filter 31 filters the supplied input signal of the frame to be processed with a predetermined cutoff frequency by using a low pass filter, and supplies the thus-obtained low frequency signal to the low frequency encoding circuit 32 and the sub-band dividing circuit 33.

At Step S12, the low frequency encoding circuit 32 encodes the low frequency signal supplied from the low pass filter 31, and supplies the thus-obtained low frequency encoded data to the multiplexing circuit 39.

At Step S13, the sub-band dividing circuit 33 equally divides the input signal and the low frequency signal into a plurality of sub-band signals each having a predetermined bandwidth.

That is, the sub-band dividing circuit 33 divides the input signal into sub-band signals of a plurality of sub-bands, and supplies sub-band signals of a sub-band sb+1 to a sub-band eb on the high frequency side obtained by the division to the number-of-sections determining feature amount calculating circuit 36 and the quasi-high frequency sub-band power difference calculating circuit 37.

Further, the sub-band dividing circuit 33 divides the low frequency signal from the low pass filter 31 into sub-band signals of a plurality of sub-bands, and supplies sub-band signals of a sub-band sb−3 to a sub-band sb on the low frequency side obtained by the division to the feature amount calculating circuit 34 and the number-of-sections determining feature amount calculating circuit 36.

At Step S14, the number-of-sections determining feature amount calculating circuit 36 calculates the number-of-sections determining feature amount based on the low frequency sub-band signal and the high frequency sub-band signal supplied from the sub-band dividing circuit 33, and supplies the calculated number-of-sections determining feature amount to the quasi-high frequency sub-band power difference calculating circuit 37.

For example, the number-of-sections determining feature amount calculating circuit 36 calculates a sub-band power sum $power_{high}(J)$ that is an estimated bandwidth of a frame J to be processed, i.e., a sum of the power of the sub-band signals of the sub-bands on the high frequency side, by calculating following Equation (1)

[Mathematical Formula 1]

$$power_{high}(J) = 10\log_{10}\left(\sum_{ib=sb+1}^{eb} power_{lin}(ib, J)\right) \tag{1}$$

In Equation (1), $power_{lin}(ib, J)$ indicates a root-mean-square value of sample values of samples of a sub-band signal of a sub-band ib (where sb+1≤ib≤eb) of the frame J. Therefore, the sub-band power sum $power_{high}(J)$ is obtained by taking a logarithm of a sum of the root-mean-square value $power_{lin}(ib, J)$ obtained for each of the sub-bands on the high frequency side.

The sub-band power sum $power_{high}(J)$ obtained in the above manner indicates the sum of the high frequency sub-band power of the sub-bands on the high frequency side of the input signal. As the sum of the power of each of the sub-bands is increased, a value of the sub-band power sum $power_{high}(J)$ is increased. That is, as the power of the high frequency component of the input signal is increased as a whole, the sub-band power sum $power_{high}(J)$ is also increased.

At Step S15, the feature amount calculating circuit 34 calculates the feature amount based on the low frequency sub-band signal supplied from the sub-band dividing circuit 33, and supplies the calculated feature amount to the quasi-high frequency sub-band power calculating circuit 35.

For example, as the feature amount, the power of each of the low frequency sub-band signals is calculated. Hereinafter, particularly the power of the low frequency sub-band signal is also referred to as a low frequency sub-band power. In addition, the power of each of the sub-band signals, such as the low frequency sub-band signal and the high frequency sub-band signal, is also referred to as a sub-band power as appropriate.

Specifically, the feature amount calculating circuit 34 calculates a sub-band power power(ib, J) of a sub-band ib (where sb−3≤ib≤sb) of the frame J to be processed, which is represented in decibel, by calculating following Equation (2).

[Mathematical Formula 2]

$$\text{power}(ib, J) = 10\log_{10}\left\{\left(\sum_{n=J\times FSIZE}^{(J+1)FSIZE-1} \times(ib, n)^2\right) \Big/ FSIZE\right\} \tag{2}$$

$$(sb-3 \le ib \le sb)$$

In Equation (2), x(ib, n) indicates a value (sample value of a sample) of the sub-band signal of the sub-band ib, and n in x(ib, n) indicates an index of a discrete time. Further, FSIZE in Equation (2) indicates the number of samples of the sub-band signal constituting one frame.

Therefore, the low frequency sub-band power power(ib, J) of the frame J is calculated by taking a logarithm of the root-mean-square value of the sample value of each sample of the low frequency sub-band signal constituting the frame J. Hereinafter, the low frequency sub-band power is considered to be calculated as the feature amount in the feature amount calculating circuit 34.

At Step S16, the quasi-high frequency sub-band power calculating circuit 35 calculates the quasi-high frequency sub-band power based on the low frequency sub-band power supplied from the feature amount calculating circuit 34 as the feature amount and the recorded estimation coefficient for each estimation coefficient that is recorded in advance.

For example, when a set of K estimation coefficients having coefficient indexes from 1 to K (where 2≤K) is prepared in advance, the quasi-high frequency sub-band power of each sub-band is calculated for the set of K estimation coefficients.

Specifically, the quasi-high frequency sub-band power calculating circuit 35 calculates the quasi-high frequency sub-band power $power_{est}$(ib, J) (where sb+1≤ib≤eb) of each of the sub-bands on the high frequency side of the frame J to be processed, by calculating following Equation (3).

[Mathematical Formula 3]

$$power_{est}(ib, J) = \left( \sum_{kb=sb-3}^{sb} \{A_{ib}(kb) \times \text{power}(kb, J)\} \right) + B_{ib} \quad (3)$$

$$(sb + 1 \le ib \le eb)$$

In Equation (3), a coefficient $A_{ib}$(kb) and a coefficient $B_{ib}$ indicate a set of estimation coefficients prepared for the sub-band ib on the high frequency side. That is, the coefficient $A_{ib}$(kb) is a coefficient multiplied by the low frequency sub-band power power(kb, J) of the sub-band kb (where sb−3≤kb≤sb), and the coefficient $B_{ib}$ is a constant term used when linearly coupling the low frequency sub-band power.

Therefore, the quasi-high frequency sub-band power $power_{est}$(ib, J) of the sub-band ib on the high frequency side is obtained by multiplying the low frequency sub-band power of each sub-band on the low frequency side by the coefficient $A_{ib}$(kb) for each sub-band and adding the coefficient $B_{ib}$ to a sum of the low frequency sub-band power multiplied by the coefficient.

Upon calculating the quasi-high frequency sub-band power of each sub-band on the high frequency side for each set of estimation coefficients, the quasi-high frequency sub-band power calculating circuit 35 supplies the calculated quasi-high frequency sub-band power to the quasi-high frequency sub-band power difference calculating circuit 37.

At Step S17, the quasi-high frequency sub-band power difference calculating circuit 37 calculates an evaluation value Res(id, J) using the frame J to be processed for the whole sets of estimation coefficients identified by the coefficient index id.

Specifically, the quasi-high frequency sub-band power difference calculating circuit 37 performs calculation similar to the above-mentioned Equation (2) by using the high frequency sub-band signal of each sub-band supplied from the sub-band dividing circuit 33, and calculates the high frequency sub-band power power(ib, J) in the frame J.

When the high frequency sub-band power power(ib, J is obtained, the quasi-high frequency sub-band power difference calculating circuit 37 calculates a residual root-mean-square value $Res_{std}$(id, J) by calculating following Equation (4).

[Mathematical Formula 4]

$$Res_{std}(id, J) = \sum_{ib=sb+1}^{eb} \{\text{power}(ib, J) - power_{est}(ib, id, J)\}^2 / (eb - sb) \quad (4)$$

That is, a difference between the high frequency sub-band power power(ib, J) and quasi-high frequency sub-band power $power_{est}$(ib, id, J) of the frame J is obtained for each sub-band ib (where sb+1≤ib≤eb) on the high frequency side, and a root-mean-square value of the difference is defined as the residual root-mean-square value $Res_{std}$(id, J).

The quasi-high frequency sub-band power $power_{est}$(ib, id, J) indicates the quasi-high frequency sub-band power of the sub-band ib obtained for the estimation coefficient having the coefficient index is id in the frame J.

Subsequently, the quasi-high frequency sub-band power difference calculating circuit 37 calculates a residual maximum value $Res_{max}$(id, J) by calculating following Equation (5).

[Mathematical Formula 5]

$$Res_{max}(id,J) = \max_{ib}\{|\text{power}(ib,J) - \text{power}_{est}(ib,id,J)|\} \quad (5)$$

In Equation (5), $\max_{ib}\{|\text{Power}(ib, J) - \text{power}_{est}(ib, id, J)|\}$ indicates the maximum value of an absolute value of the difference between the high frequency sub-band power power(ib, J) and the quasi-high frequency sub-band power $power_{est}$(ib, id, J) of each sub-band ib. Therefore, the maximum value of the absolute value of the difference between the high frequency sub-band power power(ib, J) and the quasi-high frequency sub-band power $power_{est}$(ib, id, J) in the frame J is defined as the residual maximum value $Res_{max}$(id, J).

Further, the quasi-high frequency sub-band power difference calculating circuit 37 calculates a residual average value $Res_{ave}$(id, J) by calculating following Equation (6).

[Mathematical Formula 6]

$$Res_{ave}(id, J) = \left| \left( \sum_{ib=sb+1}^{eb} \left\{ \begin{array}{c} \text{power}(ib, J) - \\ power_{est}(ib, id, J) \end{array} \right\} \right) \Big/ (eb - sb) \right| \quad (6)$$

That is, for each sub-band ib on the high frequency side, a difference between the high frequency sub-band power power(ib, J) and the quasi-high frequency sub-band power $power_{est}$(ib, id, J) of the frame J is obtained, and a sum of the difference is obtained. An absolute value of a value obtained by dividing the obtained sum of the difference by the number of sub-bands (eb-sb) on the high frequency side is defined as the residual average value $Res_{ave}$(id, J). The residual average value $Res_{ave}$(id, J) indicates a magnitude of an average value of an estimated error of each sub-band considering the sign.

In addition, when the residual root-mean-square value $Res_{std}$(id, J), the residual maximum value $Res_{max}$(id, J), and the residual average value $Res_{ave}$(id, J) are obtained, the quasi-high frequency sub-band power difference calculating circuit 37 calculates a final evaluation value Res(id, J) by calculating following Equation (7).

[Mathematical Formula 7]

$$\mathrm{Res}(id,d)=W_{std}\times\mathrm{Res}_{std}(id,J)+W_{max}\times\mathrm{Res}_{max}(id,J)+W_{ave}\times\mathrm{Res}_{ave}(id,J) \quad (7)$$

That is, the residual root-mean-square value $\mathrm{Res}_{max}$(id, J), the residual maximum value $\mathrm{Res}_{max}$(id, J), and the residual average value $\mathrm{Res}_{ave}$(id, J) are added in a weighted manner, and a result of the weighted addition is defined as the final evaluation value Res(id, J). In Equation (7), $W_{std}$, $W_{max}$, and $W_{ave}$ are weights that are determined in advance, for example, $W_{std}=1$, $W_{max}=0.5$, and $W_{ave}=0.5$.

The quasi-high frequency sub-band power difference calculating circuit 37 calculates the evaluation value Res(id, J) by performing the above-mentioned processes for every K estimation coefficients, i.e., every K coefficient indexes id.

The evaluation value Res(id, J) obtained in the above manner indicates a degree of similarity between the high frequency sub-band power calculated from the actual input signal and the quasi-high frequency sub-band power calculated by using the estimation coefficient having the coefficient index id. That is, it indicates a magnitude of the estimated error of the high frequency component.

In this manner, as the evaluation value Res(id, J) is decreased, a signal closer to the high frequency component of the actual input signal is obtained by the calculation using the estimation coefficient.

At Step S18, the quasi-high frequency sub-band power difference calculating circuit 37 determines whether or not the process has been performed for a predetermined frame length. That is, the quasi-high frequency sub-band power difference calculating circuit 37 determines whether or not the number-of-sections determining feature amount and the evaluation value have been calculated for all the frames constituting the process target section.

At Step S18, when it is determined that the process has not been performed for the predetermined frame length, the process returns to Step S11, and the above-mentioned processes are repeated. That is, a frame of the process target section, which is not yet processed is set to the next process target frame, and the number-of-sections determining feature amount and the evaluation value of the frame are calculated.

On the other hand, at Step S18, when it is determined that the process has been performed for the predetermined frame length, the process moves to Step S19.

At Step S19, the determining unit 51 determines the number of continuous frame sections constituting the process target section, based on the number-of-sections determining feature amount of each frame constituting the process target section supplied from the number-of-sections determining feature amount calculating circuit 36.

Specifically, the determining unit 51 obtains a representative value of the number-of-sections determining feature amount from the number-of-sections determining feature amount of each frame constituting the process target section. For example, the maximum value of the number-of-sections determining feature amount of each frame, i.e., the largest number-of-sections determining feature amount is defined as the representative value.

Subsequently, the determining unit 51 determines the number of continuous frame sections by comparing the obtained representative value with a threshold value that is determined in advance. For example, when the representative value is equal to or larger than 100, the number of continuous frame sections is set to 16, when the representative value is equal to or larger than 80 and smaller than 100, set to 8, and when the representative value is equal to or larger than 60 and smaller than 80, set to 4. Further, when the representative value is equal to or larger than 40 and smaller than 60, the number of continuous frame sections is set to 2, and when the representative value is smaller than 40, the number of continuous frame sections is set to 1.

The number-of-sections determining feature amount (representative value) that is compared with the threshold value at the time of determining the number of continuous frame sections indicates the sum of the high frequency sub-band power. In an audio signal such as the input signal, a section where the sum of the sub-band power on the high frequency side is large has the high frequency component that is acoustically better recognized by the human's ear (more clearly heard) compared to a section where the sub-band power is small, and hence at the time of the decoding, it is required to perform the decoding such that a signal that is closer to the original signal is obtained by the estimation.

When the representative value of the number-of-sections determining feature amount is large, the determining unit 51 increases the number of continuous frame sections so that the high frequency component of each frame can be estimated on the decoding side. With this configuration, the articulation of the audio signal obtained by the decoding can be enhanced, and hence the sound quality can be improved acoustically.

On the other hand, when the representative value is small, the power of the high frequency component is small, and hence, even though the estimation accuracy of the high frequency component by the estimation coefficient is relatively low, the acoustic degradation of the sound quality of the audio obtained by the decoding is hardly recognized. Therefore, when the representative value is small, the determining unit 51 decreases the number of continuous frame sections, thus reducing the encoding amount of the high frequency encoded data without degrading the sound quality.

At Step S20, the evaluation value sum calculating unit 52 calculates a sum of the evaluation value of the frames constituting the continuous frame section for each coefficient index, by using the evaluation value calculated for each coefficient index (set of estimation coefficients) for each frame.

For example, it is assumed that the number of continuous frame sections determined at Step S19 is ndiv, and the process target section includes 16 frames. In such a case, for example, the evaluation value sum calculating unit 52 equally divides the process target section into ndiv sections, and sets each of the obtained sections as the continuous frame section. In this case, each continuous frame section includes 16/ndiv continuous frames.

Further, the evaluation value sum calculating unit 52 calculates an evaluation value sum $\mathrm{Res}_{sum}$(id, igp) that is the sum of the evaluation value of the frame constituting each continuous frame section for each coefficient index by calculating following Equation (8).

[Mathematical Formula 8]

$$Res_{sum}(id, igp) = \sum_{ifr=igp\times 16/ndiv}^{(igp+1)\times\frac{16}{ndiv}-1} Res(id, ifr) \quad (8)$$

In Equation (8), igp is an index for identifying the continuous frame section in the process target section, and Res(id, ifr) indicates an evaluation value Res(id, ifr) of a frame ifr constituting the continuous frame section obtained for a coefficient index id.

Therefore, the evaluation value sum $Res_{sum}$(id, igp) for the coefficient index id of the continuous frame section is calculated by calculating the sum of the evaluation value of each frame having the same coefficient index id constituting the continuous frame section.

At Step S21, the selecting unit 53 selects the coefficient index of each frame based on the evaluation value sum obtained for each coefficient index for each continuous frame section.

As the value of the evaluation value Res(id, J) of each frame is decreased, a signal that is closer to the actual high frequency component is obtained by the calculation using the estimation coefficient, and hence, as the evaluation value sum $Res_{sum}$(id, igp) is decreased in the coefficient index, it can be said that the coefficient index is suitable for the continuous frame section.

The selecting unit 53 selects a coefficient index with which the evaluation value sum $Res_{sum}$(id, igp) obtained for the continuous frame section is minimized, from among a plurality of coefficient indexes, as the coefficient index of each frame constituting the continuous frame section. Therefore, in the continuous frame section, the same coefficient index is selected in each frame.

In this manner, the selecting unit 53 selects the coefficient index of the frame constituting the continuous frame section for each continuous frame section constituting the process target section.

When the coefficient index is selected based on the evaluation value sum for each continuous frame section, in some cases, the same coefficient index may be selected in continuous frame sections adjacent to each other. In such a case, the encoding device 11 handles the continuous frame sections for which the same coefficient index is selected and continuously arranged, as a single continuous frame section.

At Step S22, the generating unit 54 determines whether to use the fixed-length system as the system for generating the high frequency encoded data.

That is, the generating unit 54 compares the high frequency encoded data generated by the fixed-length system with the high frequency encoded data generated by the variable-length system, based on a selection result of the coefficient index of each frame in the process target section. When the encoding amount of the high frequency encoded data of the fixed-length system is smaller than the encoding amount of the high frequency encoded data of the variable-length system, the generating unit 54 determines to use the fixed-length system.

At Step S22, when it is determined to use the fixed-length system, the process moves to Step S23. At Step S23, the generating unit 55 generates data including the system flag indicating that the fixed-length system is selected, the fixed length index, the coefficient index, and the switch flag, and supplies the generated data to the high frequency encoding circuit 38.

For example, in the example illustrated in FIG. 3, the generating unit 54 sets the fixed length to 4 frames, and divides the process target section from the position FST1 to the position FSE1 into 4 fixed-length sections. The generating unit 54 then generates data including the fixed length index "2", the coefficient indexes "1", "2", and "3", and the switch flags "1", "0", and "1", and the system flag.

Although the coefficient indexes of the second fixed-length section and the third fixed-length section from the head of the process target section are "2" in the example illustrated in FIG. 3, because these fixed-length sections are continuously arranged, the data output from the generating unit 54 includes only one coefficient index "2".

At Step S24, the high frequency encoding circuit 38 encodes the data including the system flag, the fixed-length index, the coefficient index, and the switch flag supplied from the generating unit 54, to generate the high frequency encoded data.

For example, an entropy encoding or the like is performed as appropriate with respect to whole or part of information among the system flag, the fixed length index, the coefficient index, and the switch flag. Further, the data including the system flag, the fixed length index, and the like can also be used as the high frequency encoded data as it is.

The high frequency encoding circuit 38 supplies the generated high frequency encoded data to the multiplexing circuit 39, and then the process moves to Step S27.

On the other hand, at Step S22, when it is determined not to use the fixed-length system, i.e., when it is determined to use the variable-length system, the process moves to Step S25. At Step S25, the generating unit 54 generates data including the system flag indicating that the variable-length system is selected, the coefficient index, the section information, and the number information, and supplies the generated data to the high frequency encoding circuit 38.

For example, in the example illustrated in FIG. 2, the process target section from the position FST1 to the position FSE1 is divided into three continuous frame sections. The generating unit 54 generates data including the system flag indicating that the variable-length system is selected, the number information "num_length=3" indicating that the number of continuous frame sections is "3", the section information "length0=5" and "length1=7" indicating the length of each of the continuous frame sections, and the coefficient indexes "2", "5", and "1" of the continuous frame sections.

The coefficient index of each of the continuous frame sections is associated with the section information so that the continuous frame section can be identified for the coefficient index. Further, in the example illustrated in FIG. 2, the number of frames constituting the last continuous frame section of the process target section can be identified from the head of the process target section and the section information of the subsequent continuous frame section, and hence the section information is not generated for the last continuous frame section.

At Step S26, the high frequency encoding circuit 38 encodes the data including the system flag, the coefficient index, the section information and the number information supplied from the generating unit 54, to generate the high frequency encoded data.

For example, at Step S26, an entropy encoding or the like is performed with respect to whole or part of information among the system flag, the system flag, the coefficient index, the section information, and the number information. The high frequency encoded data can be any information so long as the estimation coefficient can be obtained from the information, for example, the data including the system flag, the coefficient index, the section information, and the number information can be used as the high frequency encoded data as it is.

The high frequency encoding circuit 38 supplies the generated high frequency encoded data to the multiplexing circuit 39, and then the process moves to Step S27.

When the high frequency encoded data is generated at Step S24 or Step S26, at Step S27, the multiplexing circuit 39 multiplexes the low frequency encoded data supplied from the low frequency encoding circuit 32 and the high frequency encoded data supplied from the high frequency encoding circuit 38. The multiplexing circuit 39 then outputs the output code string obtained by the multiplexing, thus ending the encoding process.

In this manner, the encoding device 11 calculates the number-of-sections determining feature amount based on the sub-band signal obtained from the input signal, calculates the evaluation value sum for each of the continuous frame sections when determining the number of continuous frame sections from the number-of-sections determining feature amount, and selects the coefficient index of each frame. The encoding device 11 then encodes the data including the selected coefficient index, to generate the high frequency encoded data.

As a result, by generating the high frequency encoded data by encoding the data including the coefficient index, the encoding amount of the high frequency encoded data can be reduced, compared to a case where data used for the estimation operation of the high frequency component, such as the scale factor, is encoded as it is.

Further, by determining the number of continuous frame sections based on the number-of-sections determining feature amount, the coefficient index can be prevented from being changed more than necessary with respect to the time direction, so that the acoustic sound quality of the audio obtained by the decoding can be enhanced, and at the same time, the encoding amount of the output code string can be reduced. This enables the encoding efficiency of the input signal to be enhanced.

In addition, by selecting the coefficient index for each of the continuous frame sections, the coefficient index of a more suitable estimation coefficient can be obtained for each of the continuous frame sections. In particular, by equally setting the length of each of the continuous frame sections constituting the process target section, the operation amount can be reduced, and hence the coefficient index can be selected in an expedited manner.

[Configuration of Decoding Device]

A decoding device that receives the output code string output from the encoding device 11 and performs decoding of the output code string is described below.

Figure 6:
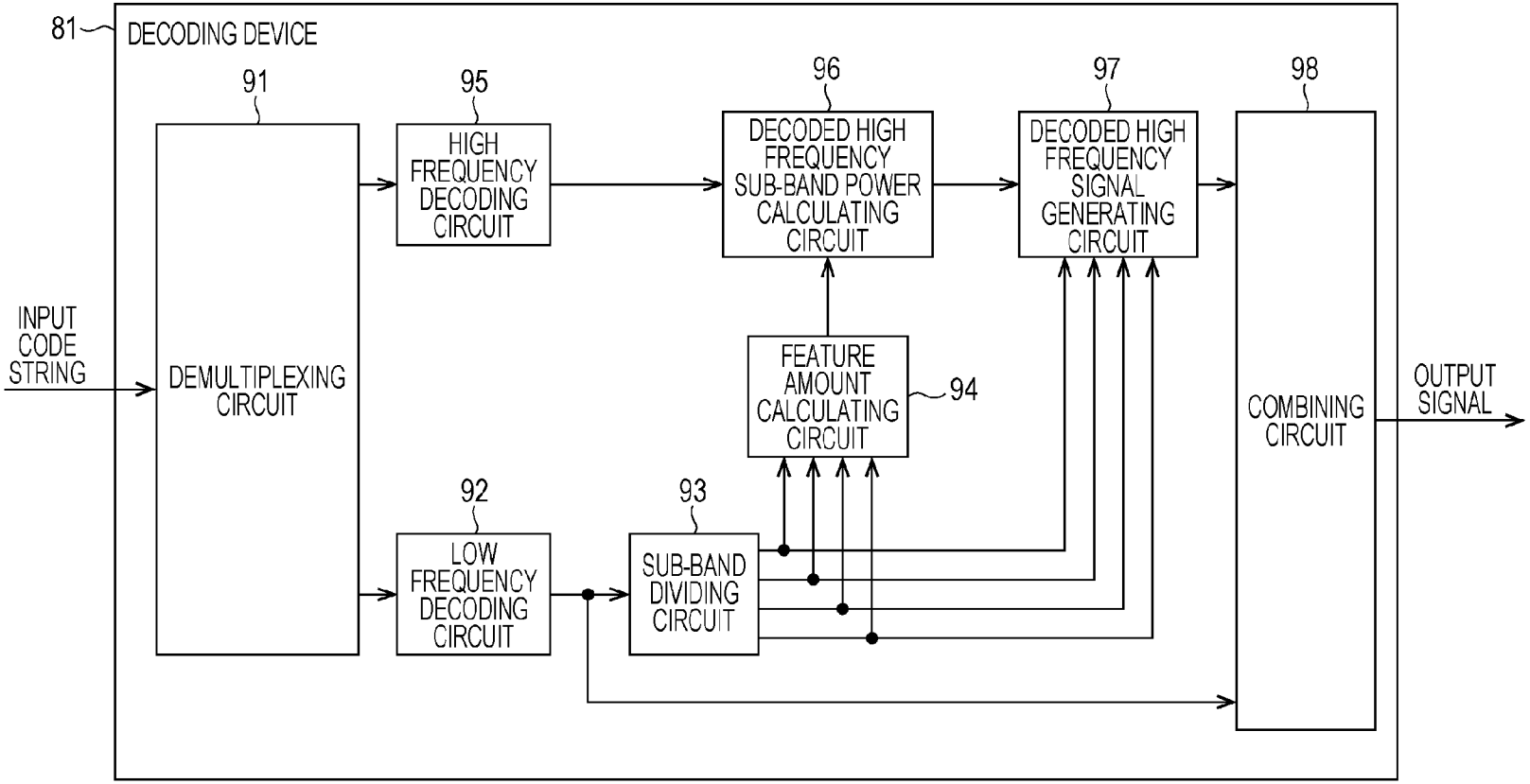
FIG. 6 is a block diagram illustrating a configuration example of a decoding device.

Such a decoding device is configured, for example, as illustrated in FIG. 6.

A decoding device 81 includes a demultiplexing circuit 91, a low frequency decoding circuit 92, a sub-band dividing circuit 93, a feature amount calculating circuit 94, a high frequency decoding circuit 95, a decoded high frequency sub-band power calculating circuit 96, a decoded high frequency signal generating circuit 97, and a combining circuit 98.

The demultiplexing circuit 91 takes the output code string received from the encoding device 11 as an input code string, and demultiplexes the input code string into the high frequency encoded data and the low frequency encoded data. Further, the demultiplexing circuit 91 supplies the low frequency encoded data obtained from the demultiplexing to the low frequency decoding circuit 92 and supplies the high frequency encoded data obtained by the demultiplexing to the high frequency decoding circuit 95.

The low frequency decoding circuit 92 decodes the low frequency encoded data from the demultiplexing circuit 91, and supplies the thus-obtained decoded low frequency signal of the input signal to the sub-band dividing circuit 93 and the combining circuit 98.

The sub-band dividing circuit 93 equally divides the decoded low frequency signal from the low frequency decoding circuit 92 into a plurality of low frequency sub-band signals each having a predetermined bandwidth, and supplies the obtained low frequency sub-band signals to the feature amount calculating circuit 94 and the decoded high frequency signal generating circuit 97.

The feature amount calculating circuit 94 calculates a low frequency sub-band power of each of the sub-bands on the low frequency side as a feature amount based on the low frequency sub-band signals from the sub-band dividing circuit 93, and supplies the calculated low frequency sub-band power to the decoded high frequency sub-band power calculating circuit 96.

The high frequency decoding circuit 95 decodes the high frequency encoded data from the demultiplexing circuit 91, and supplies data obtained as a result of the decoding and an estimation coefficient identified by a coefficient index included in the data to the decoded high frequency sub-band power calculating circuit 96. That is, the high frequency decoding circuit 95 stores therein a plurality of coefficient indexes and estimation coefficients identified by the coefficient indexes associated with each other in advance, outputs the estimation coefficient corresponding to the coefficient index included in the high frequency encoded data.

The decoded high frequency sub-band power calculating circuit 96 calculates a decoded high frequency sub-band power that is an estimated value of the sub-band power of each of the sub-bands on the high frequency side for each frame, based on the data and the estimation coefficient from the high frequency decoding circuit 95 and the low frequency sub-band power from the feature amount calculating circuit 94. For example, the same operation as the above-mentioned Equation (3) is performed to calculate the decoded high frequency sub-band power. The decoded high frequency sub-band power calculating circuit 96 supplies the calculated decoded high frequency sub-band power of each of the sub-bands to the decoded high frequency signal generating circuit 97.

The decoded high frequency signal generating circuit 97 generates a decoded high frequency signal based on the low frequency sub-band signal from the sub-band dividing circuit 93 and the decoded high frequency sub-band power from the decoded high frequency sub-band power calculating circuit 96, and supplies the generated decoded high frequency signal to the combining circuit 98.

Specifically, the decoded high frequency signal generating circuit 97 calculates the low frequency sub-band power of the low frequency sub-band signal, and performs amplitude modulation of the low frequency sub-band signal according to a ratio of the decoded high frequency sub-band power and the low frequency sub-band power. Further the decoded high frequency signal generating circuit 97 generates a decoded high frequency sub-band signal of each of the sub-bands on the high frequency side by performing a frequency modulation of the amplitude-modulated low frequency sub-band signal. The decoded high frequency sub-band signal obtained in the above manner is an estimated value of the high frequency sub-band signal of each of the sub-bands on the high frequency side of the input signal. The decoded high frequency signal generating circuit 97 supplies eh decoded high frequency signal including the obtained decoded high frequency sub-band signal of each of the sub-bands to the combining circuit 98.

The combining circuit 98 combines the decoded low frequency signal from the low frequency decoding circuit 92 and the decoded high frequency signal from the decoded high frequency signal generating circuit 97, and outputs the combined signal as an output signal. This output signal is a signal obtained by decoding the encoded input signal, including the high frequency component and the low frequency component.

Modification Example 1

[Description of Encoding Process]

Although a case is described above in which the sum of the high frequency sub-band power is obtained as the number-of-sections determining feature amount, a feature amount indicating a temporal change of the sum of the high frequency sub-band power can also be used as the number-of-sections determining feature amount.

As the feature amount indicating the temporal change of the sum of the high frequency sub-band power, for example, a feature amount indicating how much the high frequency sub-band power has been increased, i.e., a feature amount indicating an attack property can be defined as the number-of-sections determining feature amount.

Figure 7:
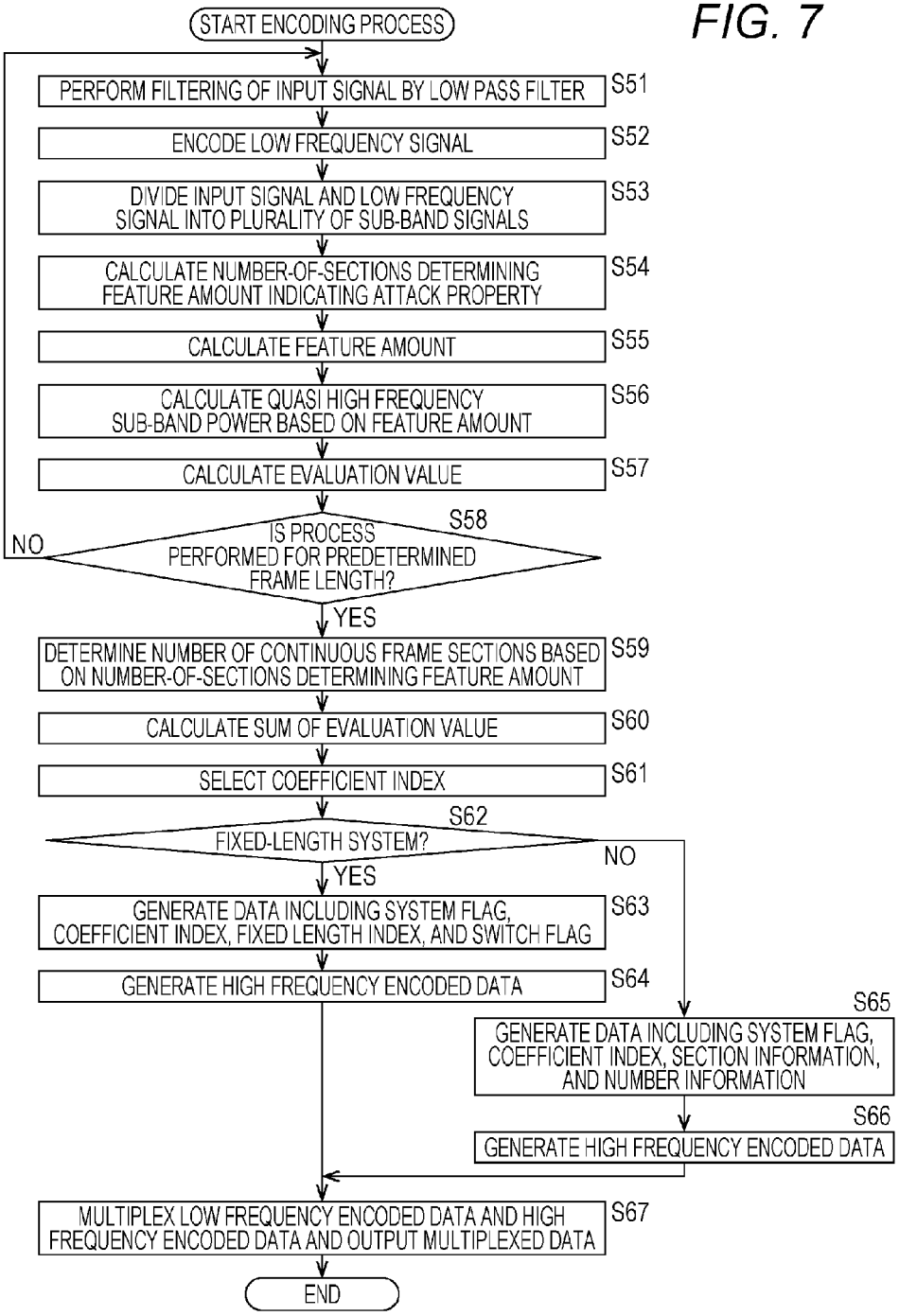
FIG. 7 is a flowchart of an encoding process.

In such a case, the encoding device 11 performs, for example, an encoding process illustrated in FIG. 7. The encoding process by the encoding device 11 is described below with reference to a flowchart illustrated in FIG. 7.

Figure 5:
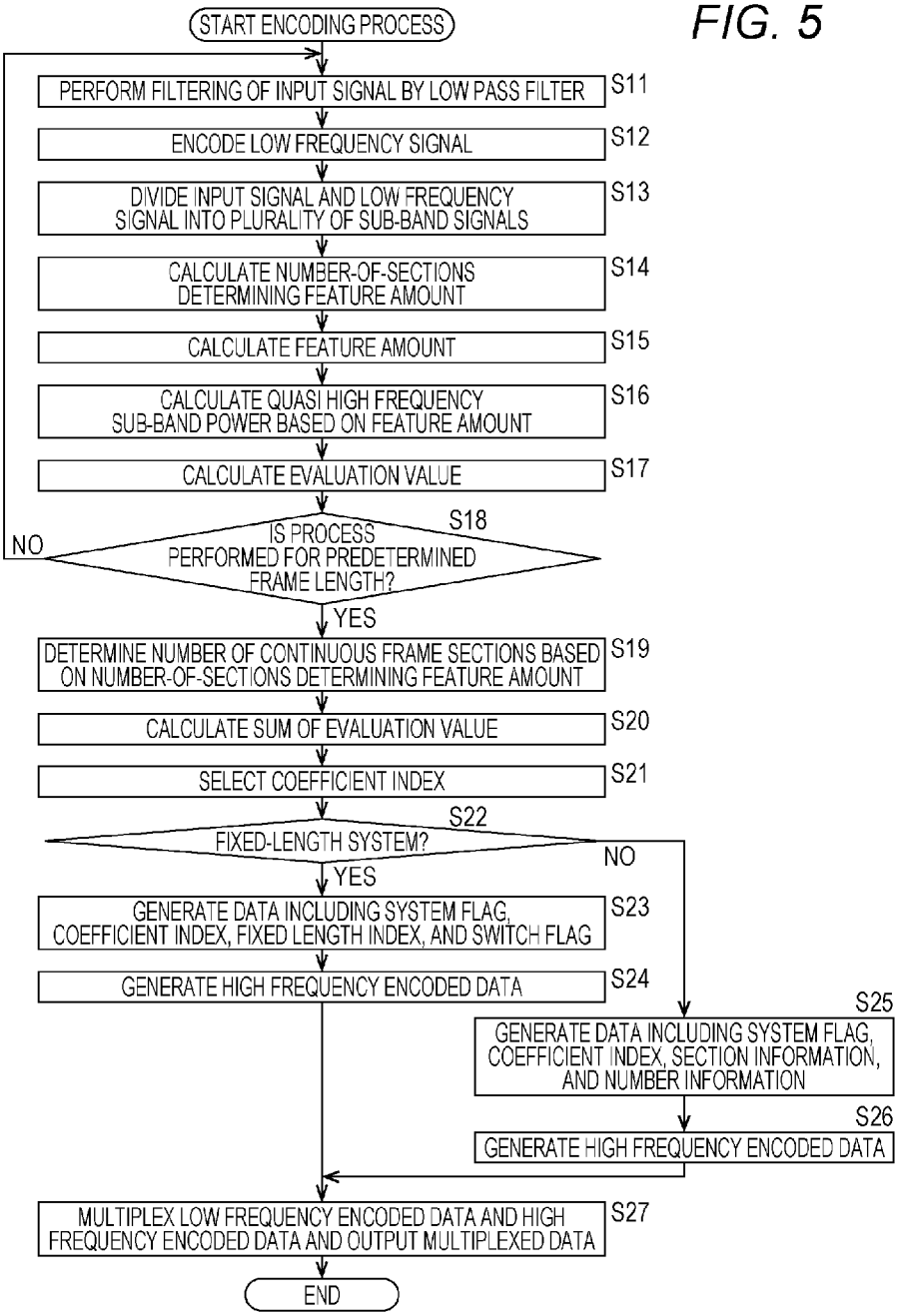
FIG. 5 is a flowchart of an encoding process.

Processes of Step S51 to Step S53 are similar to those of Step S11 to Step S13 illustrated in FIG. 5, and hence a description thereof is omitted.

At Step S54, the number-of-sections determining feature amount calculating circuit 36 calculates the number-of-sections determining feature amount indicating the attack property based on the high frequency sub-band signal supplied from the sub-band dividing circuit 33, and supplies the calculated number-of-sections determining feature amount to the quasi-high frequency sub-band power difference calculating circuit 37.

For example, the number-of-sections determining feature amount calculating circuit 36 calculates the sub-band power sum $\text{power}_{high}(J)$ of the high frequency sub-band signal of the process target frame J by calculating the above-mentioned Equation (1).

Further, the number-of-sections determining feature amount calculating circuit 36 calculates following Equation (9) based on the sub-band power for the last (L+1) frames including the frame J to be processed, and calculates the feature amount $\text{power}_{attack}(J)$ as the number-of-sections determining feature amount indicating the attack property. In this case, for example, L=16.

[Mathematical Formula 9]

$$\text{Power}_{attack}(J)=\text{power}_{high}(J)-\text{MIN}\{\text{power}_{high}(J), \text{power}_{high}(J-1), \ldots, \text{power}_{high}(J-L)\} \quad (9)$$

In Equation (9), $\text{MIN}\{\text{power}_{high}(J), \text{power}_{high}(J-1), \ldots \text{power}_{high}(J-L)\}$ indicates a function for outputting the minimum value among the sub-band power sum $\text{power}_{high}(J)$ to the sub-band power sum $\text{power}_{high}(J-L)$. Therefore, the feature amount $\text{power}_{attack}(J)$ is obtained by calculating a difference between the sub-band power sum $\text{power}_{high}(J)$ of the frame J to be processed and the minimum value of the sub-band power of the last (L+1) frames including the frame J to be processed.

The feature amount $\text{power}_{attack}(J)$ obtained in the above manner indicates a rising speed of the sub-band power sum in the time direction, i.e., an increasing speed, and hence as the feature amount $\text{power}_{attack}(J)$ is increased, a strength of the attack property of the high frequency component is increased.

After the number-of-sections determining feature amount calculating circuit 36 supplies the calculated feature amount $\text{power}_{attack}(J)$ to the quasi-high frequency sub-band power difference calculating circuit 37, processes of Step S55 to Step S67 are performed, by which the encoding process is ended.

As these processes are similar to the processes of Step S15 to Step S27 shown in FIG. 5, the description thereof is omitted. At Step S59, the determining unit 51 determines the number of continuous frame sections constituting the process target section by comparing a representative value of the feature amount $\text{power}_{attack}(J)$ indicating the attack property, which is calculated as the number-of-sections determining feature amount, with a threshold value.

Specifically, for example, the maximum value of the number-of-sections determining feature amount of each frame in the process target section is defined as a representative value, when the representative value is equal to or larger than 40, the number of continuous frame sections is set to 16, and when the representative value is equal to or larger than 30 and equal to or smaller than 40, the number of continuous frame sections is set to 8. Further, when the representative value is equal to or larger than 20 and equal to or smaller than 30, the number of continuous frame sections is set to 4, when the representative value is equal to or larger than 10 and equal to or smaller than 20, the number of continuous frame sections is set to 2, and when the representative value is smaller than 10, the number of continuous frame sections is set to 1.

For example, a section where the number-of-sections determining feature amount is large and the attack property is strong is a section where the temporal change of the sub-band power sum is large. That is, a change of the optimum estimation coefficient in the time direction is large in the section. Therefore, the determining unit 51 increases the number of continuous frame sections in the section where the representative value of the number-of-sections determining feature amount is large, such that the high frequency sub-band signal closer to the original signal can be obtained by the estimation on the decoding side. With this configuration, the articulation of the audio signal obtained by the decoding can be enhanced, and hence the sound quality can be improved acoustically.

In contrast to this, the determining unit 51 reduces the encoding amount of the high frequency encoded data without degrading the sound quality by decreasing the number of continuous frame sections in a section where the representative value is small.

In this manner, even in the case of using the number-of-sections determining feature amount indicating the attack property, the acoustic sound quality of the audio obtained by the decoding can be enhanced, and at the same time, the encoding amount of the output code string can be reduced, so that the encoding efficiency of the input signal can be enhanced.

Modification Example 2

[Description of Encoding Process]

Alternatively, a feature amount indicating a decay property can also be used as the number-of-sections determining feature amount indicating the temporal change of the sum of the high frequency sub-band power.

Figure 8:
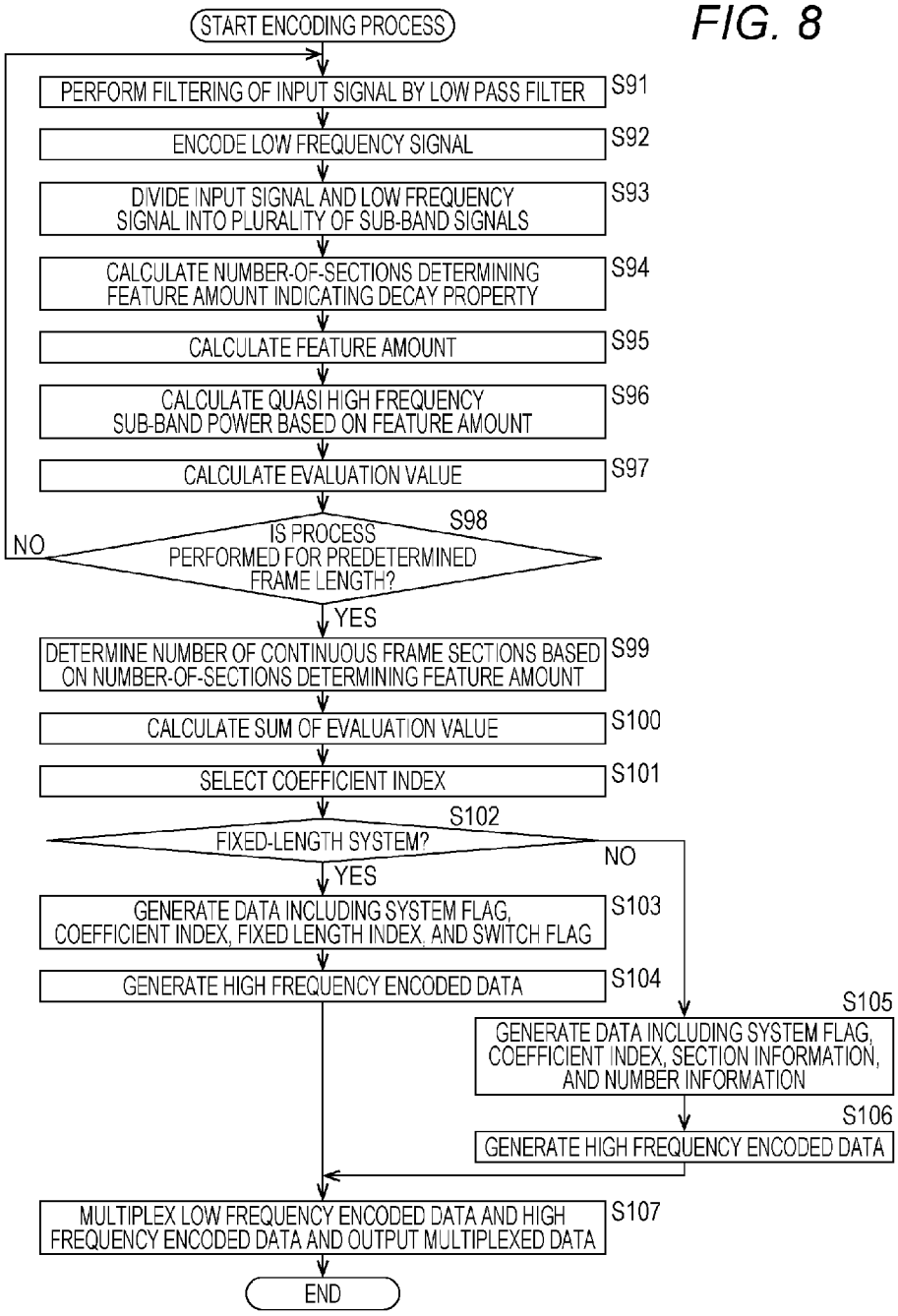
FIG. 8 is a flowchart of an encoding process.

In such a case, the encoding device 11 performs, for example, an encoding process illustrated in FIG. 8. The encoding process by the encoding device 11 is described below with reference to a flowchart illustrated in FIG. 8. Processes of Step S91 to Step S93 are similar to those of Step S11 to Step S13 illustrated in FIG. 5, and hence a description thereof is omitted.

At Step S94, the number-of-sections determining feature amount calculating circuit 36 calculates the number-of-sections determining feature amount indicating the decay property based on the high frequency sub-band signal supplied from the sub-band dividing circuit 33, and supplies the calculated number-of-sections determining feature amount to the quasi-high frequency sub-band power difference calculating circuit 37.

For example, the number-of-sections determining feature amount calculating circuit 36 calculates the sub-band power sum $power_{high}(J)$ of the high frequency sub-band signal of the process target frame J by calculating the above-mentioned Equation (1).

Further, the number-of-sections determining feature amount calculating circuit 36 calculates following Equation (10) based on the sub-band power sum for the last (M+1) frames including the frame J to be processed, and calculates the feature amount $power_{decay}(J)$ as the number-of-sections determining feature amount indicating the decay property. In this case, for example, M=16.

[Mathematical Formula 10]

$$power_{decay}(J)\mathrm{MAX}\{power_{high}(J), power_{high}(J-1), power_{high}(J-M)\}-power_{high}(J) \quad (10)$$

In Equation (10), $\mathrm{MAX}\{power_{high}(J), power_{high}(J-1), \ldots, power_{high}(J-M)\}$ indicates a function for outputting the maximum value among the sub-band power sum $power_{high}(J)$ to the sub-band power sum $power_{high}(J-M)$. Therefore, the feature amount $power_{decay}(J)$ is obtained by calculating a difference between the maximum value of the sub-band power of the last (M+1) frames including the frame J to be processed and the sub-band power sum of the frame J to be processed.

The feature amount $power_{decay}(J)$ obtained in the above manner indicates a falling speed of the sub-band power sum in the time direction, i.e., a decreasing speed, and hence as the feature amount $power_{decay}(J)$ is increased, a strength of the decay property of the high frequency component is increased.

After the number-of-sections determining feature amount calculating circuit 36 supplies the calculated feature amount $power_{decay}(J)$ to the quasi-high frequency sub-band power difference calculating circuit 37, processes of Step S95 to Step S107 are performed, by which the encoding process is ended.

As these processes are similar to the processes of Step S15 to Step S27 shown in FIG. 5, the description thereof is omitted. At Step S99, the determining unit 51 determines the number of continuous frame sections constituting the process target section by comparing a representative value of the feature amount $power_{decay}(J)$ indicating the decay property, which is calculated as the number-of-sections determining feature amount, with a threshold value.

Specifically, for example, the maximum value of the number-of-sections determining feature amount of each frame in the process target section is defined as a representative value, when the representative value is equal to or larger than 40, the number of continuous frame sections is set to 16, and when the representative value is equal to or larger than 30 and equal to or smaller than 40, the number of continuous frame sections is set to 8. Further, when the representative value is equal to or larger than 20 and equal to or smaller than 30, the number of continuous frame sections is set to 4, when the representative value is equal to or larger than 10 and equal to or smaller than 20, the number of continuous frame sections is set to 2, and when the representative value is smaller than 10, the number of continuous frame sections is set to 1.

For example, a section where the number-of-sections determining feature amount is large and the decay property is strong is a section where the temporal change of the sub-band power sum is large. Therefore, in a similar manner to the case of the number-of-sections determining feature amount indicating the attack property, the determining unit 51 increases the number of continuous frame sections in the section where the representative value of the number-of-sections determining feature amount is large. With this operation, the acoustic sound quality of the audio obtained by the decoding can be enhanced, and at the same time, the encoding amount of the output code string can be reduced, so that the encoding efficiency of the input signal can be enhanced.

Modification Example 3

[Description of Encoding Process]

Alternatively, as the number-of-sections determining feature amount, a feature amount indicating a frequency profile of the input signal can also be used.

Figure 9:
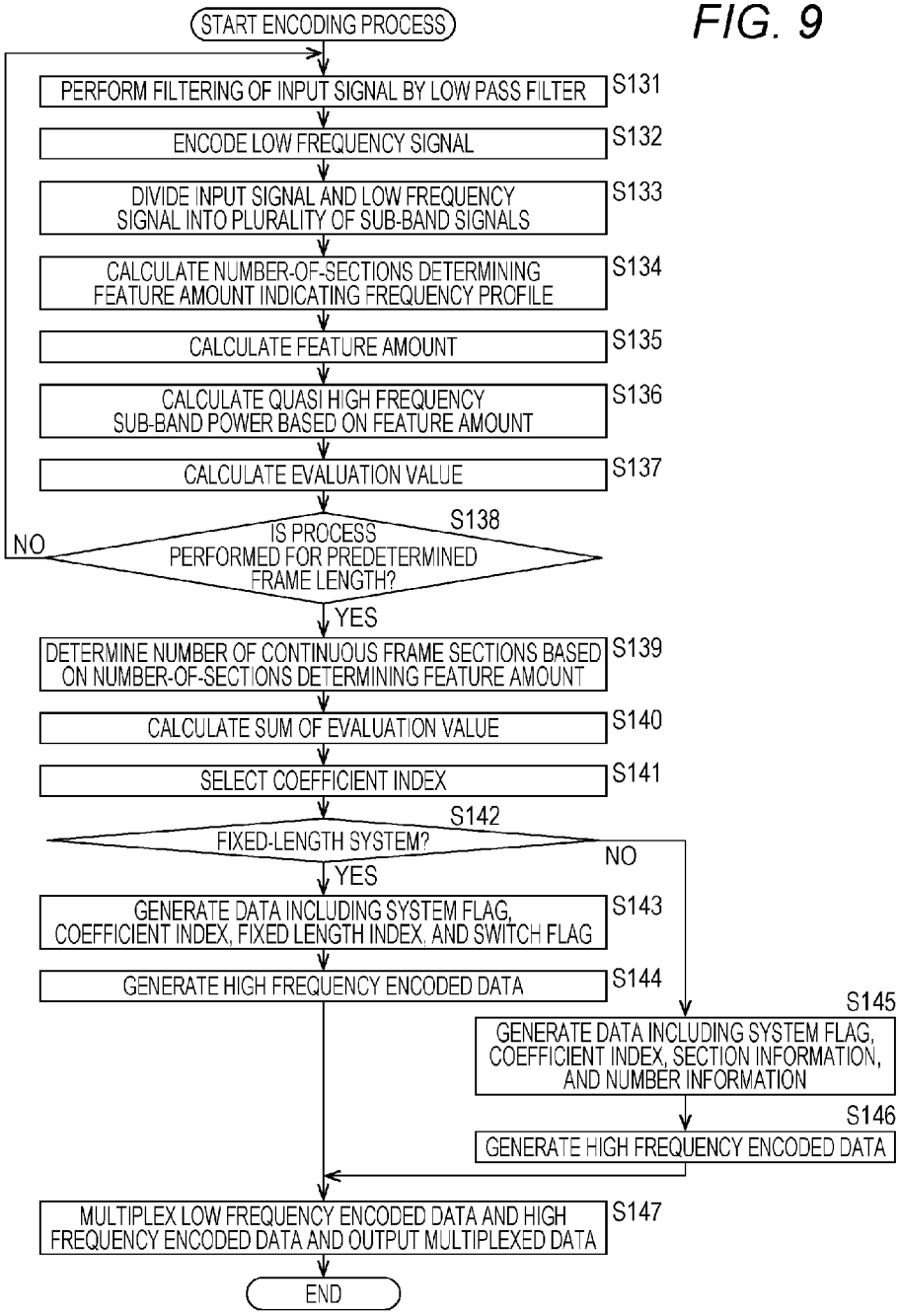
FIG. 9 is a flowchart of an encoding process.

In such a case, the encoding device 11 performs, for example, an encoding process illustrated in FIG. 9. The encoding process by the encoding device 11 is described below with respect to a flowchart illustrated in FIG. 9. Processes of Step S131 to Step S133 are similar to those of Step S11 to Step S13 illustrated in FIG. 5, and hence a description thereof is omitted.

At Step S134, the number-of-sections determining feature amount calculating circuit 36 calculates the number-of-sections determining feature amount indicating the frequency profile based on the high frequency sub-band signal supplied from the sub-band dividing circuit 33, and supplies the calculated number-of-sections determining feature amount to the quasi-high frequency sub-band power difference calculating circuit 37.

For example, the number-of-sections determining feature amount calculating circuit 36 calculates the sub-band power sum $power_{high}(J)$ of the high frequency sub-band signal of the process target frame J by calculating the above-mentioned Equation (1).

Further, the number-of-sections determining feature amount calculating circuit 36 calculates the feature amount $power_{tilt}(J)$ as the number-of-sections determining feature amount indicating the frequency profile by calculating following Equation (11).

[Mathematical Formula 11]

$$power_{tilt}(J) = power_{high}(J) - 10 \times \log_{10}\left(\sum_{ib=0}^{sb} power_{lin}(ib, J)\right) \quad (11)$$

In Equation (11), $Zpower_{lin}(ib, J)$ indicates a sum of the root-mean-square value of the sample value of each sample of the sub-band signal of the sub-band ib (where 0 ib sb) on the low frequency side.

Therefore, the feature amount $power_{tilt}(J)$, in the frame J to be processed, is obtained by subtracting a value obtained by taking a logarithm of the sum of the root-mean-square value of the sample of the sub-band signal of the sub-band on the low frequency side, i.e., the low frequency sub-band power sum, from the high frequency sub-band power sum $power_{high}(J)$. That is, the feature amount $power_{tilt}(J)$ is calculated by obtaining a difference between the low frequency sub-band power and the high frequency sub-band power.

The feature amount $power_{tilt}(J)$ obtained in the above manner indicates a ratio of the high frequency sub-band power sum to be estimated with respect to the low frequency sub-band power in the frame J to be processed. Therefore, as the value of the feature amount $power_{tilt}(J)$ is increased, in the frame J, a relative power of the high frequency side with respect to the low frequency side is increased.

After the number-of-sections determining feature amount calculating circuit 36 supplies the calculated feature amount $power_{tilt}(J)$ to the quasi-high frequency sub-band power difference calculating circuit 37, processes of Step S135 to Step S147 are performed, by which the encoding process is ended.

As these processes are similar to the processes of Step S15 to Step S27 shown in FIG. 5, the description thereof is omitted. At Step S139, the determining unit 51 determines the number of continuous frame sections constituting the process target section by comparing a representative value of the feature amount $power_{tilt}(J)$ indicating the frequency profile, which is calculated as the number-of-sections determining feature amount, with a threshold value.

Specifically, for example, the maximum value of the number-of-sections determining feature amount of each frame in the process target section is defined as a representative value, when the representative value is equal to or larger than 40, the number of continuous frame sections is set to 16, and when the representative value is equal to or larger than 30 and equal to or smaller than 40, the number of continuous frame sections is set to 8. Further, when the representative value is equal to or larger than 20 and equal to or smaller than 30, the number of continuous frame sections is set to 4, when the representative value is equal to or larger than 10 and equal to or smaller than 20, the number of continuous frame sections is set to 2, and when the representative value is smaller than 10, the number of continuous frame sections is set to 1.

For example, when the frame to be processed of the input signal is a consonant part of a human voice or a high-hat part of a musical instrument, the high frequency sub-band power sum is larger than the low frequency sub-band power sum. That is, the value of the feature amount $power_{tilt}(J)$ as the number-of-sections determining feature amount is increased.

In the frame of this type of input signal, degradation of the sound quality due to the high frequency encoding becomes relatively outstanding. Therefore, when the representative value of the number-of-sections determining feature amount is large, the determining unit 51 increases the number of continuous frame sections, such that the high frequency sub-band signal closer to the original signal can be obtained by the estimation on the decoding side. With this configuration, the articulation of the audio signal obtained by the decoding can be enhanced, and hence the sound quality can be improved acoustically.

In contrast to this, the determining unit 51 reduces the encoding amount of the high frequency encoded data without degrading the sound quality by decreasing the number of continuous frame sections in a section where the representative value is small.

In this manner, even in the case of using the number-of-sections determining feature amount indicating the frequency profile, the acoustic sound quality of the audio obtained by the decoding can be enhanced, and at the same time, the encoding amount of the output code string can be reduced, so that the encoding efficiency of the input signal can be enhanced.

Modification Example 4

Description of Encoding Process

Alternatively, a linear sum of any ones a plurality of feature amounts including the sub-band power sum, the feature amount indicating the attack property or the decay property, the feature amount indicating the frequency profile described above can also be used as the number-of-sections determining feature amount.

Figure 10:
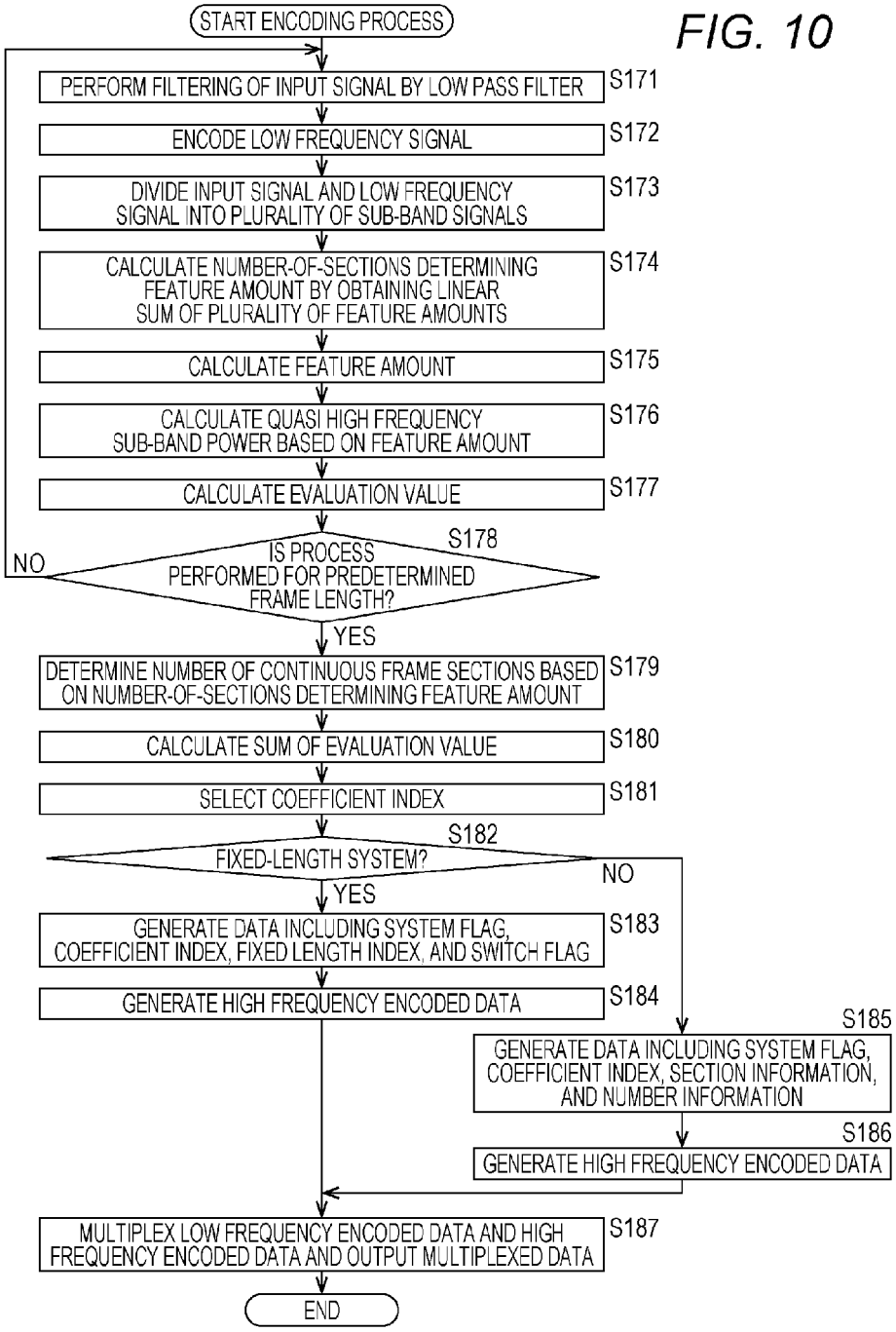
FIG. 10 is a flowchart of an encoding process.

In such a case, the encoding device 11 performs, for example, an encoding process illustrated in FIG. 10. The encoding process by the encoding device 11 is described below with reference to a flowchart illustrated in FIG. 10. Processes of Step S171 to Step S173 are similar to those of Step S11 to Step S13 illustrated in FIG. 5, and hence a description thereof is omitted.

At Step S174, the number-of-sections determining feature amount calculating circuit 36 calculates a plurality of feature amounts based on the low frequency sub-band signal and the high frequency sub-band signal supplied from the sub-band dividing circuit 33, and calculates the number-of-sections determining feature amount by obtaining a linear sum of the feature amounts.

For example, the number-of-sections determining feature amount calculating circuit 36 calculates sub-band power sum $power_{high}(J)$, the feature amount $power_{attack}(J)$, the feature amount $power_{decay}(J)$, and the feature amount $power_{tilt}(J)$ by calculating Equation (1), Equation (9), Equation (10), and Equation (11) described above.

Further, the number-of-sections determining feature amount calculating circuit 36 calculates a feature amount feature(J) by obtaining a linear sum of the sub-band power sum $power_{high}(J)$ and feature amounts such as the feature amount $power_{attack}(J)$ by calculating following Equation (12).

[Mathematical Formula 12]

$$\text{feature}(J) = W_{high} \times power_{high}(J) + W_{attack} \times power_{attack}(J) + W_{decay} \times power_{decay}(J) + W_{tilt} \times power_{tilt}(J) \quad (12)$$

In Equation (12), $W_{high}$, $W_{attack}$, $W_{decay}$, and $W_{tilt}$ are weights to be multiplied by the sub-band power sum $power_{high}(J)$, the feature amount $power_{attack}(J)$, the feature amount $power_{decay}(J)$, and the feature amounts $power_{tilt}(J)$, respectively, which are, for example, $W_{high}=1$, $W_{attack}=3$, $W_{decay}=3$, and $W_{tilt}=3$.

The value of the feature amount feature(J) obtained in the above manner is increased as the high frequency sub-band power sum is increased, as the temporal change of the sub-band power is increased, or as the high frequency sub-band power is increased with respect to the low frequency sub-band power. Alternatively, a nonlinear sum of a plurality of feature amounts can be calculated as the number-of-sections determining feature amount.

After the number-of-sections determining feature amount calculating circuit 36 supplies the feature amount feature(J) calculated as the number-of-sections determining feature amount to the quasi-high frequency sub-band power difference calculating circuit 37, processes of Step S175 to Step S187 are performed, by which the encoding process is ended.

As these processes are similar to the processes of Step S15 to Step S27 shown in FIG. 5, the description thereof is omitted. At Step S179, the determining unit 51 determines the number of continuous frame sections constituting the process target section by comparing a representative value of the feature amount feature(J) with a threshold value.

Specifically, for example, when the maximum value of the number-of-sections determining feature amount of the frames in the process target section is defined as the representative value and the representative value is equal to or larger than 460, the number of continuous frame sections is set to 16, and when the representative value is equal to or larger than 350 and equal to or smaller than 460, the number of continuous frame sections is set to 8. Further, when the representative value is equal to or larger than 240 and equal to or smaller than 350, the number of continuous frame sections is set to 4, when the representative value is equal to or larger than 130 and equal to or smaller than 240, the number of continuous frame sections is set to 2, and when the representative value is smaller than 130, the number of continuous frame sections is set to 1.

Even in the case of using the feature amount feature(J) as the number-of-sections determining feature amount, the acoustic sound quality of the audio obtained by the decoding can be enhanced, and at the same time, the encoding amount of the output code string can be reduced, by increasing the number of continuous frame sections as a section includes a larger number-of-sections determining feature amount. This enables the encoding efficiency of the input signal to be enhanced.

Second Embodiment

[Description of Encoding Process]

While it is described above that the process target section is divided into a plurality of continuous frame sections with the same section length, the continuous frames constituting the process target section can be configured to have different lengths from each other. Setting the lengths of the continuous frame sections different from each other as appropriate, the coefficient index of each frame can be selected more properly, and hence the sound quality of the audio obtained by the decoding can be further enhanced.

Figure 11:
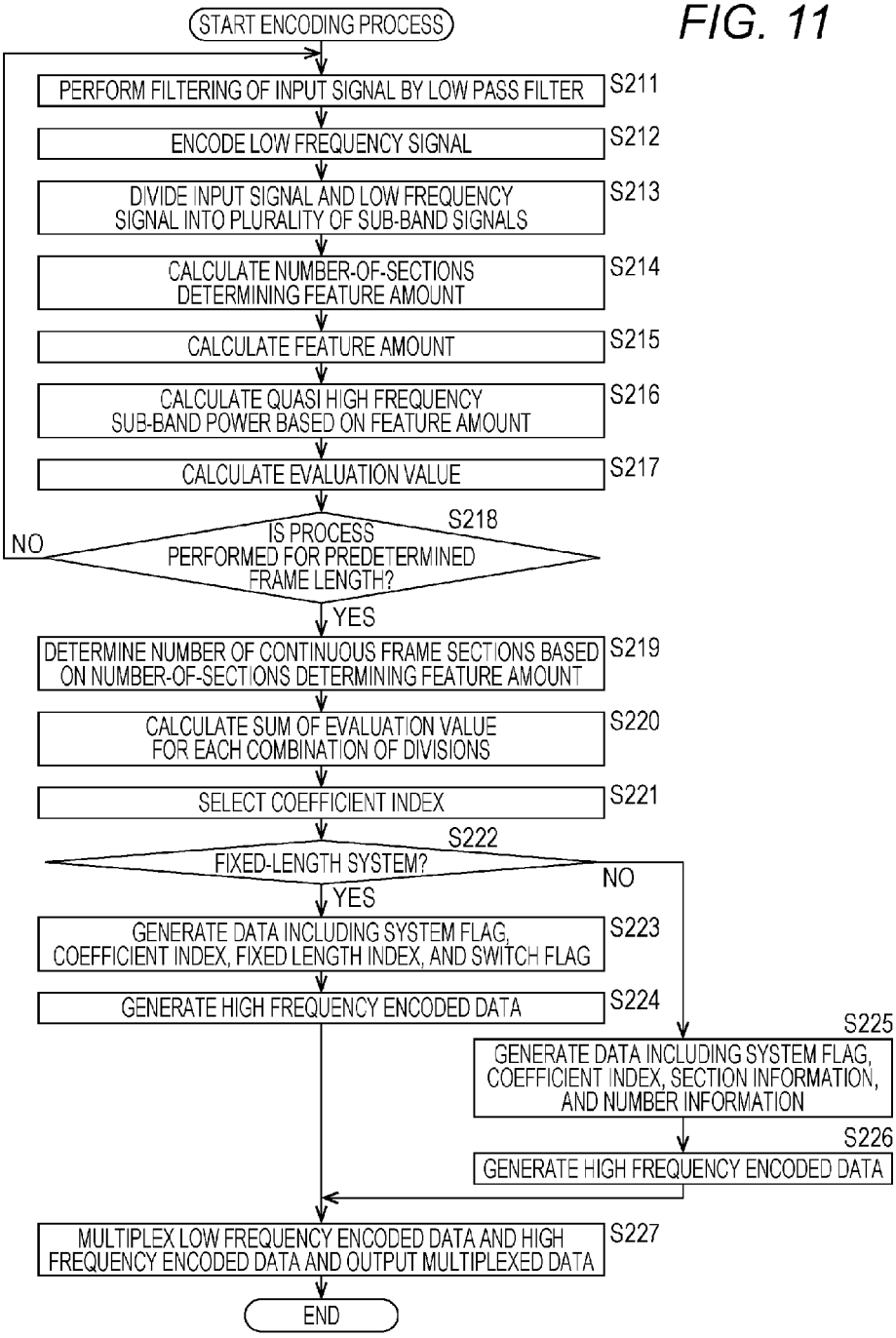
FIG. 11 is a flowchart of an encoding process.

When setting the lengths of the continuous frame sections different from each other, the encoding device 11 performs an encoding process illustrated in FIG. 11. The encoding process by the encoding device 11 is described below with reference to a flowchart illustrated in FIG. 11. Processes of Step S211 to Step S219 are similar to those of Step S11 to Step S19 illustrated in FIG. 5, and hence a description thereof is omitted.

At Step S220, the evaluation value sum calculating unit 52 calculates a sum of the evaluation value of the frames constituting the continuous frame section for each coefficient index by using the evaluation value calculated for each coefficient index (set of estimation coefficients) for each of the frames.

For example, assuming that the number of continuous frame sections determined at Step S219 is ndiv, the evaluation value sum calculating unit 52 divides the process target section into ndiv continuous frames sections of arbitrary lengths. In this case, the lengths of the continuous frame sections can be the same or different from each other.

Specifically, when the number of continuous frame sections ndiv is 3, for example, the process target section illustrated in FIG. 2 is divided into three sections including a section from the position FST1 to the position FC1, a section from the position FC1 to the position FC2, and a section from the position FC2 to the position FSE1. Each of the three sections is then defined as the continuous frame section.

When the process target section is divided into the continuous frame sections, the evaluation value sum calculating unit 52 calculates the evaluation value sum $Res_{sum}(id, igp)$ of the frame constituting the continuous frame section for each coefficient index by performing a calculation of the above-mentioned Equation (8).

For example, for the section from the position FST1 to the position FC1 illustrated in FIG. 2, the sum of the evaluation value of the frames constituting the section is calculated for each coefficient index. Similarly, for the section from the position FC1 to the position FC2 and the section from the position FC2 to the position FSE1, the sum of the evaluation value is calculated for each coefficient index.

With this operation, the evaluation value sum $Res_{sum}(id, igp)$ of the continuous frame section is obtained for each coefficient index for each of the continuous frame sections constituting the process target section.

The evaluation value sum calculating unit 52 calculates the evaluation value sum of each of the continuous frame sections of the process target section for each coefficient index for each combination of divisions that can be taken when dividing the process target section into ndiv continuous frame sections. For example, the example illustrated in FIG. 2 shows a combination of divisions in the case where the process target section is divided into three continuous frame sections.

At Step S221, the selecting unit 53 selects the coefficient index of each of the frames based on the evaluation value sum of the continuous frame section of each coefficient index obtained for each combination of divisions of the process target section.

Specifically, the selecting unit 53 selects the coefficient index for each of the continuous frame sections of the combination for each combination of divisions of the process target section. That is, the selecting unit 53 selects a coefficient index with which the evaluation value sum obtained for the continuous frame section is minimized, from among a plurality of coefficient indexes, as the coefficient index of the continuous frame section.

Further, the selecting unit 53 obtains a sum of the evaluation value sum of the coefficient index selected in each of the continuous frame sections for the combination of divisions of the process target section.

For example, in the example illustrated in FIG. 2, it is assumed that the coefficient indexes "2", "5", and "1" are selected respectively for the section from the position FST1 to the position FC1, the section from the position FC1 to the position FC2, and the section from the position FC2 to the position FSE1.

In this case, a sum of the evaluation value sum of the coefficient index "2" of the section from the position FST1 to the position FC1, the evaluation value sum of the coefficient index "5" of the section from the position FC1 to the position FC2, and the evaluation value sum of the coefficient index "1" of the section from the position FC2 to the position FSE1 is obtained.

The evaluation value sum obtained in the above manner can be considered as a sum of the evaluation value of the coefficient index of each of the frames when the coefficient index is selected for each of the frames for a predetermined combination of divisions of the process target section. Therefore, the combination of divisions with which the sum of the evaluation value sum is minimized becomes the combination with which the most optimum coefficient index is selected for each of the frames, considering the entire process target section.

When the sum of the evaluation value sum is obtained for each combination of division of the process target section, the selecting unit 53 identifies a combination with which the sum of the evaluation value sum is minimized. The selecting unit 53 then sets each continuous frame section of the identified combination as the final continuous frame section, and selects the coefficient index selected in the continuous frame section as the final coefficient index of each frame constituting the continuous frame section.

After the coefficient index of the frame constituting the continuous frame section is selected for each of the continuous frame sections in the above manner, processes of Step S222 to Step S227 are performed, by which the encoding process is ended. These processes are similar to the processes of Step S22 to Step S27 illustrated in FIG. 5, and hence a description thereof is omitted.

In this manner, the encoding device 11 calculates the number-of-sections determining feature amount, determines the number of continuous frame sections from the number-of-sections determining feature amount, calculates the sum of the evaluation value sum of the continuous frame section for each combination of the continuous frame sections, and selects the coefficient index of each frame from the sum of the evaluation value sum.

By calculating the sum of the evaluation value sum of the continuous frame section for each combination of continuation frame sections and determining the optimum combination of continuous frame sections and the coefficient index of each of the continuous frame sections, the high frequency component can be estimated with high accuracy at the time of decoding. As a result, the acoustic sound quality of the audio obtained by the decoding can be enhanced, and at the same time, the encoding amount of the output code string can be reduced, and hence the encoding efficiency of the input signal can be enhanced.

Although a case where the sub-band power sum $power_{high}$ (J) is calculated as the number-of-sections determining feature amount is described at Step S214 illustrated in FIG. 11, other feature amount can be calculated as the number-of-sections determining feature amount. For example, the feature amount $power_{attack}$(J), the feature amount $power_{decay}$ (J), the feature amount $power_{tilt}$(J), the feature amount feature(J), or the like can be obtained as the number-of-sections determining feature amount.

Third Embodiment

[Example Structure of an Encoding Device]

When the present technology is applied to a case where the low frequency component is encoded considering the encoding amount of the high frequency encoded data of the input signal, the encoding can be performed more simply in an expedited manner. When considering the encoding amount of the high frequency encoded data at the time of encoding the low frequency component, the encoding device can be configured, for example, as illustrated in FIG. 12.

Figure 12:
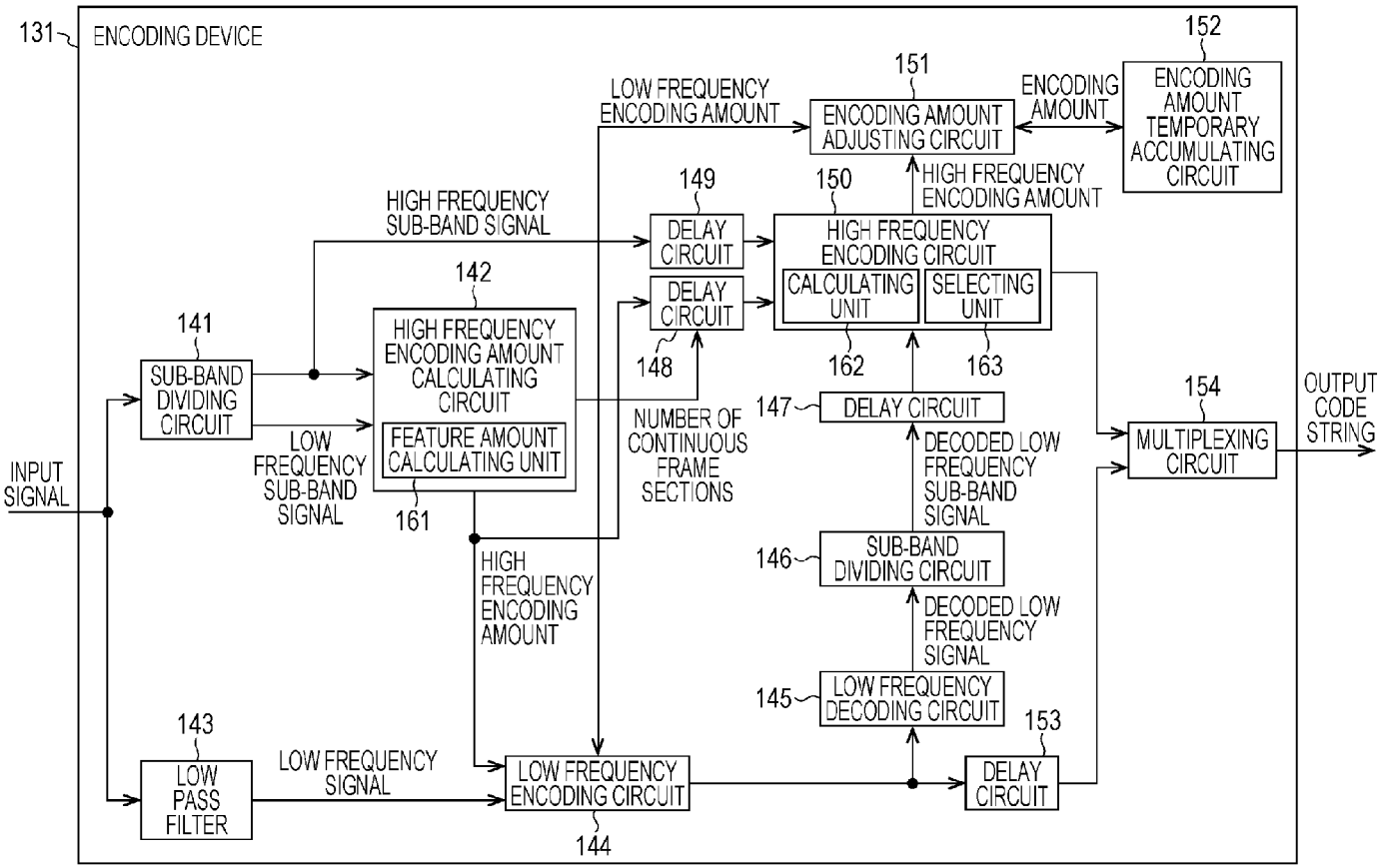
FIG. 12 is a block diagram illustrating another configuration example of the encoding device.

The encoding device 131 illustrated in FIG. 12 encodes the input signal that is an audio signal in units of process target section including a plurality of frames, for example, 16 frames, and outputs an output code string obtained as a result of the encoding. A case where an encoding device 131 generates the high frequency encoded data by the variable-length system is described below as an example. However, in the encoding device 131, a switch between the variable-length system and the fixed-length system is not performed, and hence the system flag is not included in the high frequency encoded data.

The encoding device 131 includes a sub-band dividing circuit 141, a high frequency encoding amount calculating circuit 142, a low pass filter 143, a low frequency encoding circuit 144, a low frequency decoding circuit 145, a sub-band dividing circuit 146, a delay circuit 147, a delay circuit 148, a delay circuit 149, a high frequency encoding circuit 150, an encoding amount adjusting circuit 151, an encoding amount temporary accumulating circuit 152, a delay circuit 153, and a multiplexing circuit 154.

The sub-band dividing circuit 141 divides the input signal into a plurality of sub-band signals, supplies the obtained low frequency sub-band signal to the high frequency encoding amount calculating circuit 142, and supplies the high frequency sub-band signal to the high frequency encoding amount calculating circuit 142 and the delay circuit 149.

The high frequency encoding amount calculating circuit 142 calculates an encoding amount of the high frequency encoded data obtained by encoding the high frequency component of the input signal (hereinafter, a "high frequency encoding amount") based on the low frequency sub-band signal and the high frequency sub-band signal supplied from the sub-band dividing circuit 141.

The high frequency encoding amount calculating circuit 142 includes a feature amount calculating unit 161 that calculates the number-of-sections determining feature amount based on at least one of the low frequency sub-band signal or the high frequency sub-band signal. Further, the high frequency encoding amount calculating circuit 142 determines the number of continuous frame sections based on the number-of-sections determining feature amount and calculates the high frequency encoding amount from the number of continuous frame sections.

The high frequency encoding amount calculating circuit 142 supplies the number of continuous frame sections to the delay circuit 148, and supplies the high frequency encoding amount to the low frequency encoding circuit 144 and the delay circuit 148.

The low pass filter 143 filters the supplied input signal, and supplies the low frequency signal obtained as a result of the filtering, which is the low frequency component of the input signal, to the low frequency encoding circuit 144.

The low frequency encoding circuit 144 encodes the low frequency signal from the low pass filter 143 such that the encoding amount of the low frequency encoded data obtained by encoding the low frequency signal is equal to or smaller than an encoding amount obtained by subtracting the high frequency encoding amount supplied from the high frequency encoding amount calculating circuit 142 from an encoding amount that can be used for the process target section of the input signal. The low frequency encoding circuit 144 supplies the low frequency encoded data obtained by encoding the low frequency signal to the low frequency decoding circuit 145 and the delay circuit 153.

The low frequency decoding circuit 145 decodes the low frequency encoded data supplied from the low frequency encoding circuit 144, and supplies the decoded low frequency signal obtained as a result of the decoding to the sub-band dividing circuit 146. The sub-band dividing circuit 146 divides the decoded low frequency signal supplied from the low frequency decoding circuit 145 into sub-band signals of a plurality of sub-bands on the low frequency side (hereinafter, "decoded low frequency sub-band signals"), and supplies the decoded low frequency sub-band signals to the delay circuit 147. Frequency bands of the sub-bands of the decoded low frequency sub-band signals are respectively the same as those of the sub-bands of the low frequency sub-band signals.

The delay circuit 147 delays the decoded low frequency sub-band signal from the sub-band dividing circuit 146, and supplies the delayed decoded low frequency sub-band signal to the high frequency encoding circuit 150. The delay circuit 148 delays the high frequency encoding amount from the high frequency encoding amount calculating circuit 142 and the number of continuous frame sections by a predetermined period, and supplies the delayed signals to the high frequency encoding circuit 150. The delay circuit 149 delays the high frequency sub-band signal from the sub-band dividing circuit 141, and supplies the delayed high frequency sub-band signal to the high frequency encoding circuit 150.

The high frequency encoding circuit 150 encodes information for obtaining the power of the high frequency sub-band signal from the delay circuit 149 by an estimation based on the feature amount obtained from the decoded low frequency sub-band signal from the delay circuit 147 and the number of continuous frame sections from the delay circuit 148, such that the encoding amount is equal to or smaller than the high frequency encoding amount from the delay circuit 148.

The high frequency encoding circuit 150 includes a calculating unit 162 and a selecting unit 163. The calculating unit 162 calculates the evaluation value of each of the sub-bands on the high frequency side for each coefficient index indicating the estimation coefficient, and the selecting unit 163 selects the coefficient index of each frame based on the evaluation value calculated by the calculating unit 162.

Further, the high frequency encoding circuit 150 supplies the high frequency encoded data obtained by encoding data including the coefficient index to the multiplexing circuit 154, and supplies the high frequency encoding amount of the high frequency encoded data to the encoding amount adjusting circuit 151.

When the actual high frequency encoding amount obtained by the high frequency encoding circuit 150 is smaller than the high frequency encoding amount of the high frequency encoding amount calculating circuit 142 obtained through the delay circuit 148, the encoding amount adjusting circuit 151 supplies the surplus encoding amount to the encoding amount temporary accumulating circuit 152. The encoding amount temporary accumulating circuit 152 accumulates the surplus encoding amount. This surplus encoding amount is appropriately sued for the next and the subsequent process target sections.

The delay circuit 153 delays the low frequency encoded data obtained by the low frequency encoding circuit 144 by a predetermined period, and supplies the delayed signal to the multiplexing circuit 154. The multiplexing circuit 154 multiplexes the low frequency encoded data from the delay circuit 153 and the high frequency encoded data from the high frequency encoding circuit 150, and outputs the output code string obtained as a result of the multiplexing.

[Description of Encoding Process]

An operation of the encoding device 131 is described below. When the input signal is supplied to the encoding device 131 and the encoding of the input signal is instructed, the encoding device 131 performs the encoding process to encode the input signal.

Figure 13:
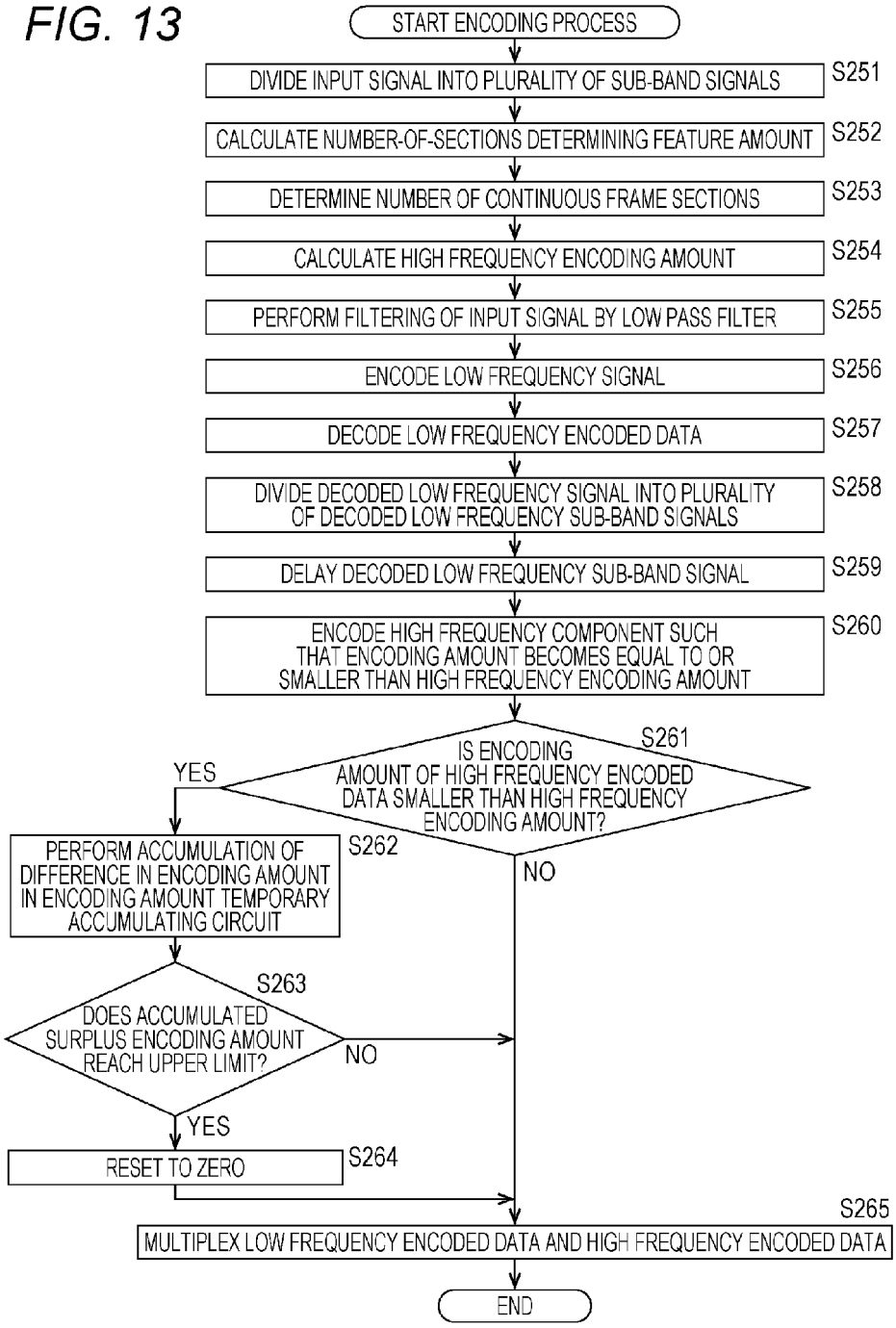
FIG. 13 is a flowchart of an encoding process.

The encoding process by the encoding device 131 is described below with reference to a flowchart illustrated in FIG. 13. This encoding process is performed in units of process target section of the input signal (for example, 16 frames).

At Step S251, the sub-band dividing circuit 141 equally divides the supplied input signal into a plurality of sub-band signals having a predetermined bandwidth. The sub-band signals in a specific range on the low frequency side, among the obtained sub-band signals, are defined as the low frequency sub-band signals, and sub-band signals in a specific range on the high frequency side are defined as the high frequency sub-band signals.

The sub-band dividing circuit 141 supplies the low frequency sub-band signals obtained by the sub-band division to the high frequency encoding amount calculating circuit 142, and supplies the high frequency sub-band signal to the high frequency encoding amount calculating circuit 142 and the delay circuit 149.

For example, the range of the sub-band of the high frequency sub-band signal is set on a side of the encoding device 131 depending on a property, a bit rate, and the like of the input signal. Further, the range of the sub-band of the low frequency sub-band signal is set to a frequency band including a predetermined number of sub-bands in which a sub-band on the low frequency side next to the lowest frequency sub-band of the high frequency sub-band signal is set to the highest frequency sub-band of the low frequency sub-band signal.

The ranges of the sub-bands of the low frequency sub-band signal and the high frequency sub-band signal are considered to be same between the encoding device 131 and the side of the decoding device.

At Step S252, the feature amount calculating unit 161 of the high frequency encoding amount calculating circuit 142 calculates the number-of-sections determining feature amount based on at least one of the low frequency sub-band signal or the high frequency sub-band signal supplied from the sub-band dividing circuit 141.

For example, the feature amount calculating unit 161 calculates the feature amount $power_{attack}(J)$ indicating the attack property of the high frequency area as the number-of-sections determining feature amount by calculating the above-mentioned Equation (9). The number-of-sections determining feature amount is calculated for each frame constituting the process target section.

Further, as the number-of-sections determining feature amount, the sub-band power sum $power_{high}(J)$, the feature amount $power_{decay}(J)$, the feature amount $power_{tilt}(J)$, the feature amount feature(J), a nonlinear sum of a plurality of feature amounts, or the like can also be calculated.

At Step S253, the high frequency encoding amount calculating circuit 142 determines the number of continuous frame sections based on the number-of-sections determining feature amount of each frame of the process target section.

For example, the high frequency encoding amount calculating circuit 142 sets the maximum value of the number-of-sections determining feature amount of each frame of the process target section as the representative value of the number-of-sections determining feature amount, and determines the number of continuous frame sections by comparing the representative value with a predetermined threshold value.

Specifically, for example, when the representative value is equal to or larger than 40, the number of continuous frame sections is set to 16, and when the representative value is equal to or larger than 30 and equal to or smaller than 40, the number of continuous frame sections is set to 8. Further, when the representative value is equal to or larger than 20 and equal to or smaller than 30, the number of continuous frame sections is set to 4, when the representative value is equal to or larger than 10 and equal to or smaller than 20, the number of continuous frame sections is set to 2, and when the representative value is smaller than 10, the number of continuous frame sections is set to 1.

At Step S254, the high frequency encoding amount calculating circuit 142 calculates the high frequency encoding amount of the high frequency encoded data based on the determined number of continuous frame sections.

In the encoding device 131, as the high frequency encoded data is generated by the variable-length system, the high frequency encoded data includes the number information, the section information, and the coefficient index.

As the number of continuous frame sections constituting the process target section is determined at the present time, when the number of continuous frame sections is nDiv, the high frequency encoded data includes one piece of number information, (nDiv−1) pieces of section information, and nDiv coefficient indexes.

The section information is set to (nDiv−1), because the length of the process target section is determined in advance, and if the length of the (nDiv−1) continuous frame sections is known, the length the rest of one continuous frame section can be identified.

Therefore, the encoding amount of the high frequency encoded data can be obtained from (number of bits to describe number information)+(nDiv−1)×(number of bits to describe one piece of section information)+(nDiv)×(number of bits to describe one coefficient index).

In this manner, in the encoding device 131, the high frequency encoding amount of the high frequency encoded data can be obtained with less operation amount even without actually encoding the high frequency component of the input signal, the encoding of the low frequency component can be started in an expedited manner.

That is, in the past process, when determining the encoding amount needed for the high frequency encoded data, the necessary encoding amount cannot be obtained unless the low frequency sub-band power and the high frequency sub-band power of the input signal are calculated and the coefficient index is selected for each frame. In contrast to this, the encoding device 131 only calculates the number-of-sections determining feature amount, and hence the high frequency encoding amount can be determined with less operation in an expedited manner.

Although a case where the high frequency encoded data is generated by the variable-length system at Step S254 as an example, even in the case where the high frequency encoded data is generated by the fixed-length system, the high frequency encoding amount can be calculated based on the number of continuous frame sections.

When the high frequency encoded data is generated by the fixed-length system, the high frequency encoded data includes the fixed length index, the switch flag, and the coefficient index.

In this case, as can be seen from FIG. 3, the high frequency encoded data includes one fixed length index, (nDiv−1) switch flags, and nDiv coefficient indexes. Therefore, the encoding amount of the high frequency encoded data can be obtained from (number of bits to describe fixed length index)+(nDiv−1)×(number of bits to describe one switch flag)+(nDiv)×(number of bits to describe one coefficient index).

When the high frequency encoding amount is calculated, the high frequency encoding amount calculating circuit 142 supplies the calculated high frequency encoding amount to the low frequency encoding circuit 144 and the delay circuit 148, and supplies the number of continuous frame sections to the delay circuit 148.

At Step S255, the low pass filter 143 filters the supplies input signal with a low pass filter, and supplies the low frequency signal obtained as a result of the filtering to the low frequency encoding circuit 144. Although the cutoff frequency of the low pass filter used in the filtering process can be set to an arbitrary frequency, in the present embodiment, the cutoff frequency is set to correspond to the highest frequency of the above-mentioned low frequency sub-band signal.

At Step S256, the low frequency encoding circuit 144 encodes the low frequency signal from the low pass filter 143 such that the encoding amount of the low frequency encoded data is equal to or smaller than the low frequency encoding amount, and supplies the low frequency encoded data obtained as a result of the encoding to the low frequency decoding circuit 145 and the delay circuit 153.

The low frequency encoding amount mentioned here is the encoding amount as a target of the low frequency encoded data. The low frequency encoding circuit 144 calculates the low frequency encoding amount by subtracting the high frequency encoding amount supplied from the high frequency encoding amount calculating circuit 142 from an encoding amount that can be used for the whole process target section, which is determined in advance, and adding the surplus encoding amount accumulated in the encoding amount temporary accumulating circuit 152 to the result of the subtraction.

When the encoding amount of the low frequency encoded data obtained by actually encoding the low frequency signal is smaller than the low frequency encoding amount, the low frequency encoding circuit 144 supplies the actual encoding amount of the low frequency encoded data and the low frequency encoding amount to the encoding amount adjusting circuit 151.

The encoding amount adjusting circuit 151 supplies an encoding amount obtained by subtracting the actual encoding amount of the low frequency encoded data from the low frequency encoding amount supplied from the low frequency encoding circuit 144 to the encoding amount temporary accumulating circuit 152 to add the encoding amount to the surplus encoding amount. With this operation, the surplus encoding amount recorded in the encoding amount temporary accumulating circuit 152 is updated.

On the other hand, when the actual encoding amount of the low frequency encoded data matches the low frequency encoding amount, the encoding amount adjusting circuit 151 causes the encoding amount temporary accumulating circuit 152 to perform the update of the surplus encoding amount with zero increment of the surplus encoding amount.

At Step S257, the low frequency decoding circuit 145 decodes the low frequency encoded data supplied from the low frequency encoding circuit 144, and supplies the decoded low frequency signal obtained by the decoding to the sub-band dividing circuit 146. In the encoding device 131, various methods can be adopted as the encoding method of encoding and decoding the low frequency signal, and for example, the ACELP (Algebraic Code Excited Linear Prediction), the AAC (Advanced Audio Coding) or the like can be adopted.

At Step S258, the sub-band dividing circuit 146 divides the decoded low frequency signal supplied from the low frequency decoding circuit 145 into decoded low frequency sub-band signals of a plurality of sub-bands, and supplies the decoded low frequency sub-band signals to the delay circuit 147. The lowest and highest frequencies of each of the sub-bands in the sub-band division is considered to be same as those in the sub-band division performed by the sub-band dividing circuit 141 at Step S251. That is, the frequency band of each of the sub-bands of the decoded low frequency sub-band signal is considered to be same as that of each of the sub-bands of the low frequency sub-band signal.

At Step S259, the delay circuit 147 delays the decoded low frequency sub-band signal supplied from the sub-band dividing circuit 146 by a specific time sample, and supplies the delayed signal to the high frequency encoding circuit 150. The delay circuit 148 and the delay circuit 149 delay the number of continuous frame sections, the high frequency encoding amount, and the high frequency sub-band signal, and supplies the delayed signals to the high frequency encoding circuit 150.

The delay amount at the delay circuit 147 or the delay circuit 148 is to take a synchronization of the high frequency sub-band signal, the high frequency encoding amount, and the decoded low frequency sub-band signal, and needs to be set to an appropriate value by the low frequency or high frequency encoding method. Depending on the configuration of the encoding method, the delay amount of each delay circuit can be set to zero. The function of the delay circuit 153 is similar to the function of the delay circuit 147, and hence a description thereof is omitted.

At Step S260, the high frequency encoding circuit 150 encodes the high frequency component of the input signal such that the encoding amount is equal to or smaller than the high frequency encoding amount from the delay circuit 148, based on the decoded low frequency sub-band signal from the delay circuit 147, the number of continuous frame sections from the delay circuit 148, and the high frequency sub-band signal from the delay circuit 149.

For example, the calculating unit 162 calculates the low frequency sub-band power power(ib, J) of each of the low frequency sub-bands by performing the similar operation to the above-mentioned Equation (2) based on the decoded low frequency sub-band signal, and calculates the high frequency sub-band power of each of the high frequency sub-bands from the high frequency sub-band signal by performing the similar operation. Further, the calculating unit 162 calculates the quasi-high frequency sub-band power of each of the high sub-bands by performing the operation of Equation (3) based on the low frequency sub-band power and the set of estimation coefficients recorded in advance.

The calculating unit 162 calculates the evaluation value Res(id, J) of each frame by performing the operations of the above-mentioned Equation (4) to Equation (7) based on the high frequency sub-band power and the quasi-high frequency sub-band power. The calculation of the evaluation value Res(id, J) is performed for each coefficient index indicating the set of estimation coefficients used in the calculation of the low frequency sub-band power.

Further, the calculating unit 162 equally divides the process target section into a number of sections indicated by the number of continuous frame sections, and defines each of the divided sections as the continuous frame section. The calculating unit 162 calculates the evaluation value sum $Res_{sum}$(id, igp) for each coefficient index by calculating the above-mentioned Equation (8) by using the evaluation value calculated for each coefficient index for each of the frames.

Moreover, the selecting unit 163 selects the coefficient index of each of the frames by performing the similar process to that of Step S21 illustrated in FIG. 5 based on the evaluation value sum obtained for each coefficient index for each of the continuous frame sections. That is, a coefficient index with which the evaluation value sum $Res_{sum}$(id, igp) obtained for the continuous frame set is minimized is selected as the coefficient index of each of the frames constituting the continuous frame section.

The same coefficient index may be selected at continuous frame sections adjacent to each other, and in such a case, the continuous frame sections for which the same coefficient index is selected and which are continuously arranged are finally considered to be one continuous frame section.

When the coefficient index of each frame is selected, the high frequency encoding circuit 150 encodes the data including the section information, the number information, and the coefficient index by performing the similar process to those of Step S25 and Step S26 illustrated in FIG. 5, to generate the high frequency encoded data.

The encoding amount of the high frequency encoded data obtained in the above manner is always equal to or smaller than the high frequency encoding amount. For example, when the same coefficient index is selected for the continuous frame sections that are continuously arranged, the final number of continuous frame sections is smaller than the number of continuous frame sections obtained by the high frequency encoding amount calculating circuit 142. In this case, not only the number of coefficient indexes included in the high frequency encoded data is smaller than the number of continuous frame sections obtained by the high frequency encoding amount calculating circuit 142 but also the number of pieces of the section information is decreased.

Therefore, in this case, the actual encoding amount of the high frequency encoded data is smaller than the high frequency encoding amount obtained by the high frequency encoding amount calculating circuit 142.

On the other hand, when the same coefficient index is not selected for the continuous frame sections that are continuously arranged, the number of continuous frame sections matches the number of continuous frame sections obtained by the high frequency encoding amount calculating circuit 142, and hence the actual encoding amount of the high frequency encoded data also matches the high frequency encoding data.

Although a case where the process target section is equally divided into the continuous frame sections is described at Step S260, the process target section can also be divided into a plurality of continuous frame sections of arbitrary lengths.

In such a case, at Step S260, after the evaluation value Res(id, J) of each frame is calculated, similar processes to those of Step S220 and Step S221 illustrated in FIG. 11 are performed, so that the coefficient index of each frame is selected. Thereafter, the data including the selected coefficient index, the fixed length index, and the switch flag is encoded, to generate the high frequency encoded data.

At Step S261, the high frequency encoding circuit 150 determines whether or not the encoding amount of the high frequency encoded data obtained by the encoding is smaller than the high frequency encoding amount calculated at Step S254.

At Step S261, when it is determined that the encoding amount of the high frequency encoded data is not smaller than the high frequency encoding amount, i.e., when the encoding amount of the high frequency encoded data matches the high frequency encoding amount, no plus or minus change of sign is generated, and hence the process moves to Step S265. In this case, the high frequency encoding circuit 150 supplies the high frequency encoded data obtained by the high frequency encoding to the multiplexing circuit 154.

On the other hand, at Step S261, when it is determined that the encoding amount of the high frequency encoded data is smaller than the high frequency encoding amount, at Step S262, the encoding amount adjusting circuit 151 accumulates a difference between the encoding amount of the high frequency encoded data and the high frequency encoding amount in the encoding amount temporary accumulating circuit 152. That is, an encoding amount of the difference between the encoding amount of the high frequency encoded data and the high frequency encoding amount is added to the surplus encoding amount accumulated in the encoding amount temporary accumulating circuit 152, so that the surplus encoding amount is updated. The encoding amount temporary accumulating circuit 152 described above is also used in the AAC by the name of bit resolver, to perform an adjustment of the encoding amount between frames to be processed.

At Step S263, the encoding amount adjusting circuit 151 determines whether or not the surplus encoding amount accumulated in the encoding amount temporary accumulating circuit 152 has reached a predetermined upper limit.

For example, in the encoding amount temporary accumulating circuit 152, an upper limit of the encoding amount that can be accepted as the surplus encoding amount (hereinafter, an "upper limit encoding amount") is determined in advance. When the surplus encoding amount has reached the upper limit encoding amount at the time of accumulating the difference between the encoding amount of high frequency encoded data and the high frequency encoding amount in the encoding amount temporary accumulating circuit 152, which is started at Step S262, the encoding amount adjusting circuit 151 determines that the surplus encoding amount has reached the upper limit at Step S263.

At Step S263, when it is determined that the surplus encoding amount has not reached the upper limit, the whole difference between the encoding amount of the high frequency encoded data and the high frequency encoding amount is added to the surplus encoding amount, so that the surplus encoding amount is updated. Thereafter, the high frequency encoding circuit 150 supplies the high frequency encoded data obtained by the high frequency encoding to the multiplexing circuit 154, and the process moves to Step S265.

On the other hand, when it is determined that the surplus encoding amount has reached the upper limit at Step S263, at Step S264, the high frequency encoding circuit 150 resets to zero with respect to the high frequency encoded data.

When the surplus encoding amount has reached the upper limit while the difference between the encoding amount of the high frequency encoded data and the high frequency encoding amount is added to the surplus encoding amount, the encoding amount of the difference between the encoding amount of the high frequency encoded data and the high frequency encoding amount, which is left without being added to the surplus encoding amount, is left unprocessed. This unprocessed encoding amount cannot be added to the surplus encoding amount, and hence the high frequency encoding circuit 150 adds a sign "0" to the end of the high frequency encoded data for the unprocessed encoding amount, such that the unprocessed encoding amount is apparently seemed to be used to generate the high frequency encoded data. At the time of decoding, the sign "0" added to the end of the high frequency encoded data is not used in the decoding of the input signal.

When the reset of adding the sign "0" to the end of the high frequency encoded data is performed, the high frequency encoding circuit 150 supplies the high frequency encoded data after the reset to the multiplexing circuit 154, and the process moves to Step S265.

When it is determined that the encoding amount of the high frequency encoded data is not smaller than the high frequency encoding amount at Step S261, when it is determined that the surplus encoding amount has not reached the upper limit at Step S263, or when the reset is performed at Step S264, the process of Step S265 is performed.

That is, at Step S265, the multiplexing circuit 154 generates the output code string by multiplexing the low frequency encoded data from the delay circuit 153 and the high frequency encoded data from the high frequency encoding circuit 150, and outputs the output code string. In this case, the multiplexing circuit 154 multiplexes the low frequency encoded data and the high frequency encoded data together with an index indicating upper and lower sub-bands of the input signal on the low frequency side. By outputting the output code string in this manner, the encoding process is ended.

As described above, the encoding device 131 calculates the high frequency encoded data by calculating the number of continuous frame sections from the high frequency and low frequency sub-band signals, encodes the low frequency signal with the encoding amount determined from the high frequency encoding amount, and encodes the high frequency component based on the decoded low frequency signal obtained by decoding the low frequency encoded data and the high frequency encoding amount.

In this manner, by calculating the high frequency encoding amount from the number of continuous frame sections, the encoding amount needed for the high frequency encoding can be obtained without performing the encoding of the high frequency component. Therefore, compared to the conventional method, the operation amount can be reduced when calculating the high frequency encoding amount by an operation needed to select the coefficient index of each of the frames. Further, considering the characteristic of the input signal, the bit usage amount (encoding amount) of the high frequency encoded data can be determined more properly than the conventional method.

In addition, the encoding technology described above can be applied to, for example, the AC-3(ATSC A/52 "Digital Audio Compression Standard (AC-3)") that is one of the audio encoding systems or the like.

In the AC-3, one frame of an audio signal includes a plurality of blocks, and information on whether or not to use a value of an exponential part in a floating point representation of a coefficient after a frequency conversion in an immediately previous block as it is at each of the blocks is included in a bit stream.

In this case, a set of continuous blocks that share the value of the same exponential part in one frame is referred to as a continuous block section. In an encoding device of the general AC-3 system, when the input signal to be encoded in the frame is in a steady state, i.e., a signal with less temporal change, one frame includes a large number of continuous block sections.

By determining the number of such continuous block sections appropriately by applying the present technology described above, the encoding can be performed efficiently with the minimum necessary continuous block sections, i.e., the minimum necessary bit usage amount.

A series of processes described above can be executed by hardware or can be executed by software. When the series of processes is performed by software, a program constituting the software is installed from a program recording medium in a computer embedded in dedicated hardware, a general-purpose personal computer configured to execute various functions by installing various programs, or the like.

Figure 14:
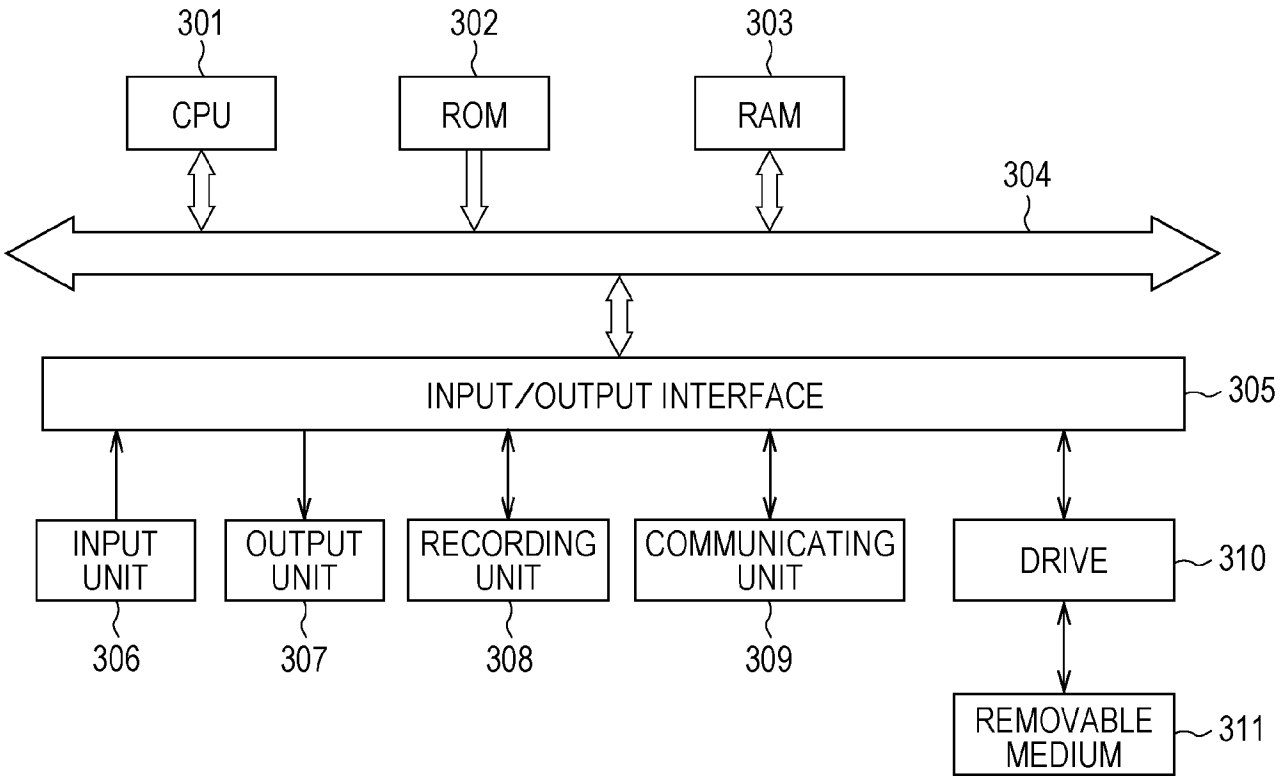
FIG. 14 is a block diagram illustrating a configuration example of a computer.

FIG. 14 is a block diagram illustrating a configuration example of hardware of a computer that implements a series of processes described above by executing a program.

In the computer, a CPU (Central Processing Unit) 301, a ROM (Read Only Memory) 302, and a RAM (Random Access Memory) 303 are connected to one another by a bus 304.

An input/output interface 305 is further connected to the bus 304. An input unit 306 including a keyboard, a mouse, a microphone, or the like, an output unit 307 including a speaker or the like, a recording unit 308 including a hard disk, a nonvolatile memory, or the like, a communicating unit 309 including a network interface or the like, a drive 310 for driving a removable medium 311 such as a magnetic disk, an optical disk, a magnetic optical disk, or a semiconductor memory are connected to the input/output interface 305.

In the computer configured in the above manner, for example, CPU 301 loads the program recorded in the recording unit 308 into the RAM 303 via the input/output interface 305 and the bus 304 and executes the loaded program, by which a series of processes described above is performed.

The program executed by the computer (CPU 301) can be provided by, for example, being recorded in a magnetic disk (including a flexible disk), an optical disk (CD-ROM (Compact Disc-Read Only Memory), a DVD (Digital Versatile Disc), and the like), a magnetic optical disk, or the removable medium 311 that is a packaged medium including a semiconductor memory, or provided via a wired or wireless medium such as a local area network, the Internet, a digital satellite broadcasting, or the like.

The program can be installed in the recording unit 308 via the input/output interface 305 by mounting the removable medium 311 on the drive 310. Further, the program can be received by the communicating unit 309 via a wired or wireless transmission medium and installed in the recording unit 308. Alternatively, the program can be pre-installed in the ROM 302 or the recording unit 308.

The programs to be executed by the computer may be programs for performing operations in chronological order in accordance with the sequence described in this specification, or may be programs for performing operations in parallel or performing an operation when necessary, such as when there is a call.

Further, the embodiment of the present technology is not limited to the above-mentioned embodiments, but various modifications may be made without departing from the spirit or scope of the general inventive concept of the present technology.

Moreover, the present technology can also be implemented by the following configuration.

[1]

An encoding device, including:

a sub-band dividing unit configured to generate a low frequency sub-band signal of a sub-band on a low frequency side of an input signal and a high frequency sub-band signal of a sub-band on a high frequency side of the input signal;

a quasi-high frequency sub-band power calculating unit configured to calculate a quasi-high frequency sub-band power that is an estimated value of a high frequency sub-band power of the high frequency sub-band signal based on the low frequency sub-band signal and a predetermined estimation coefficient;

a feature amount calculating unit configured to calculate a number-of-sections determining feature amount based on at least one of the low frequency sub-band signal or the high frequency sub-band signal;

a determining unit configured to determine the number of continuous frame sections including frames for which the same estimation coefficient is selected in a process target section including a plurality of frames of the input signal, based on the number-of-sections determining feature amount;

a selecting unit configured to select the estimation coefficient of a frame that constitutes the continuous frame section from a plurality of estimation coefficients based on the quasi-high frequency sub-band power and the high frequency sub-band power in each continuous frame section obtained by dividing the process target section based on the determined number of continuous frame sections;

a generating unit configured to generate data for obtaining the estimation coefficient selected in a frame of each of the continuous frame sections constituting the process target section;

a low frequency encoding unit configured to encode a low frequency signal of the input signal to generate low frequency encoded data; and a multiplexing unit configured to multiplex the data and the low frequency encoded data to generate an output code string.

[2]

The encoding device according to [1], wherein the number-of-sections determining feature amount includes a feature amount indicating a sum of the high frequency sub-band power.

[3]

The encoding device according to [1], wherein the number-of-sections determining feature amount includes a feature amount indicating a temporal change of a sum of the high frequency sub-band power.

[4]

The encoding device according to [1], wherein the number-of-sections determining feature amount includes a feature amount indicating a frequency profile of the input signal.

[5]

The encoding device according to [1], wherein the number-of-sections determining feature amount includes a linear sum or a nonlinear sum of a plurality of feature amounts.

[6]

The encoding device according to any one of [1] to [5], further including an evaluation value sum calculating unit configured to calculate, based on an evaluation value indicating an error between the quasi-high frequency sub-band power and the high frequency sub-band power in the frame calculated for each of the estimation coefficients, a sum of the evaluation value of each frame constituting the continuous frame section for each of the estimation coefficients, wherein the selecting unit is configured to select the estimation coefficient of the frame of the continuous frame section based on the sum of the evaluation value calculated for each of the estimation coefficients.

[7]

The encoding device according to [6], wherein each section obtained by equally dividing the process target section by the determined number of continuous frame sections is defined as the continuous frame section.

[8]

The encoding device according to [6], wherein the selecting unit is configured to select the estimation coefficient of the frame of the continuous frame section based on the sum of the evaluation value for each combination of divisions of the process target section that can be taken when dividing the process target section by the determined number of continuous frame sections, identify a combination with which the sum of the evaluation values of the selected estimation coefficients of all the frames constituting the process target section is minimized from among the combinations, and define the estimation coefficient selected in each frame as the estimation coefficient of the corresponding frame in the identified combination.

[9]

The encoding device according to any one of [1] to [8], further including a high frequency encoding unit configured to encode the data to generate high frequency encoded data, wherein the multiplexing unit is configured to generate the output code string by multiplexing the high frequency encoded data and the low frequency encoded data.

[10]

The encoding device according to [9], wherein the determining unit is configured to further calculate an encoding amount of the high frequency encoded data of the process target section based on the determined number of continuous frame sections, and the low frequency encoding unit is configured to encode the low frequency signal with an encoding amount determined from an encoding amount determined in advance for the process target section and the calculated encoding amount of the high frequency encoded data.

[11]

An encoding method, including the steps of:

generating a low frequency sub-band signal of a sub-band on a low frequency side of an input signal and a high frequency sub-band signal of a sub-band on a high frequency side of the input signal;

calculating a quasi-high frequency sub-band power that is an estimated value of a high frequency sub-band power of the high frequency sub-band signal based on the low frequency sub-band signal and a predetermined estimation coefficient;

calculating a number-of-sections determining feature amount based on at least one of the low frequency sub-band signal or the high frequency sub-band signal;

determining the number of continuous frame sections including frames for which the same estimation coefficient is selected in a process target section including a plurality of frames of the input signal, based on the number-of-sections determining feature amount;

selecting the estimation coefficient of a frame that constitutes the continuous frame section from a plurality of estimation coefficients based on the quasi-high frequency sub-band power and the high frequency sub-band power in each continuous frame section obtained by dividing the process target section based on the determined number of continuous frame sections;

generating data for obtaining the estimation coefficient selected in a frame of each of the continuous frame sections constituting the process target section;

generating low frequency encoded data by encoding a low frequency signal of the input signal; and generating an output code string by multiplexing the data and the low frequency encoded data.

[12]

A program configured to cause a computer to execute the steps of:

generating a low frequency sub-band signal of a sub-band on a low frequency side of an input signal and a high frequency sub-band signal of a sub-band on a high frequency side of the input signal;

calculating a quasi-high frequency sub-band power that is an estimated value of a high frequency sub-band power of the high frequency sub-band signal based on the low frequency sub-band signal and a predetermined estimation coefficient;

calculating a number-of-sections determining feature amount based on at least one of the low frequency sub-band signal or the high frequency sub-band signal;

determining the number of continuous frame sections including frames for which the same estimation coefficient is selected in a process target section including a plurality of frames of the input signal, based on the number-of-sections determining feature amount;

selecting the estimation coefficient of a frame that constitutes the continuous frame section from a plurality of estimation coefficients based on the quasi-high frequency sub-band power and the high frequency sub-band power in each continuous frame section obtained by dividing the process target section based on the determined number of continuous frame sections;

generating data for obtaining the estimation coefficient selected in a frame of each of the continuous frame sections constituting the process target section;

generating low frequency encoded data by encoding a low frequency signal of the input signal; and generating an output code string by multiplexing the data and the low frequency encoded data.

[13]

A decoding device, including:

a demultiplexing unit configured to demultiplex an input code string into data for obtaining an estimation coefficient selected in a frame of each continuous frame section constituting a process target section, which is generated based on a result of calculating an estimated value of a high frequency sub-band power of a high frequency sub-band signal of an input signal based on a low frequency sub-band signal of the input signal and a predetermined estimation coefficient, determining the number of continuous frame sections including frames for which the same estimation coefficient is selected in the process target section including a plurality of frames of the input signal based on a number-of-sections determining feature amount extracted from the input signal, and selecting the estimation coefficient of a frame constituting the continuous frame section from a plurality of estimation coefficients based on the estimated value and the high frequency sub-band power in each of the continuous frame sections obtained by dividing the process target section based on the determined number of continuous frame sections, and low frequency encoded data obtained by encoding a low frequency signal of the input signal;

a low frequency decoding unit configured to decode the low frequency encoded data to generate a low frequency signal;

a high frequency signal generating unit configured to generate a high frequency signal based on the estimation coefficient obtained from the data and the low frequency signal obtained from the decoding; and a combining unit configured to generate an output signal based on the high frequency signal and the low frequency signal obtained from the decoding.

[14]

The decoding device according to [13], further including a high frequency decoding unit configured to decode the data to obtain the estimation coefficient.

[15]

The decoding device according to [13] or [14], wherein based on an evaluation value indicating an error between the estimated value and the high frequency sub-band power in the frame calculated for each of the estimation coefficients, a sum of the evaluation value of each frame constituting the continuous frame section is calculated for each of the estimation coefficients, and based on the sum of the evaluation value calculated for each of the estimation coefficients, the estimation coefficient of the frame of the continuous frame section is selected.

[16]

The decoding device according to [15], wherein each section obtained by equally dividing the process target section by the determined number of continuous frame sections is defined as the continuous frame section.

[17]

The decoding device according to [15], wherein the estimation coefficient of the frame of the continuous frame section is selected based on the sum of the evaluation value for each combination of divisions of the process target section that can be taken when dividing the process target section by the determined number of continuous frame sections, a combination with which the sum of the evaluation values of the selected estimation coefficients of all the frames constituting the process target section is minimized is identified from among the combinations, and the estimation coefficient selected in each frame is defined as the estimation coefficient of the corresponding frame in the identified combination.

[18]

A decoding method, including the steps of:

demultiplexing an input code string into data for obtaining an estimation coefficient selected in a frame of each continuous frame section constituting a process target section, which is generated based on a result of calculating an estimated value of a high frequency sub-band power of a high frequency sub-band signal of an input signal based on a low frequency sub-band signal of the input signal and a predetermined estimation coefficient, determining the number of continuous frame sections including frames for which the same estimation coefficient is selected in the process target section including a plurality of frames of the input signal based on a number-of-sections determining feature amount extracted from the input signal, and selecting the estimation coefficient of a frame constituting the continuous frame section from a plurality of estimation coefficients based on the estimated value and the high frequency sub-band power in each of the continuous frame sections obtained by dividing the process target section based on the determined number of continuous frame sections, and low frequency encoded data obtained by encoding a low frequency signal of the input signal;

generating a low frequency signal by decoding the low frequency encoded data;

generating a high frequency signal based on the estimation coefficient obtained from the data and the low frequency signal obtained from the decoding; and generating an output signal based on the high frequency signal and the low frequency signal obtained from the decoding.

[19]

A program configured to cause a computer to execute the steps of:

demultiplexing an input code string into data for obtaining an estimation coefficient selected in a frame of each continuous frame section constituting a process target section, which is generated based on a result of calculating an estimated value of a high frequency sub-band power of a high frequency sub-band signal of an input signal based on a low frequency sub-band signal of the input signal and a predetermined estimation coefficient, determining the number of continuous frame sections including frames for which the same estimation coefficient is selected in the process target section including a plurality of frames of the input signal based on a number-of-sections determining feature amount extracted from the input signal, and selecting the estimation coefficient of a frame constituting the continuous frame section from a plurality of estimation coefficients based on the estimated value and the high frequency sub-band power in each of the continuous frame sections obtained by dividing the process target section based on the determined number of continuous frame sections, and low frequency encoded data obtained by encoding a low frequency signal of the input signal;

generating a low frequency signal by decoding the low frequency encoded data;

generating a high frequency signal based on the estimation coefficient obtained from the data and the low frequency signal obtained from the decoding; and generating an output signal based on the high frequency signal and the low frequency signal obtained from the decoding.

REFERENCE SIGNS LIST

11 encoding device, 32 low frequency encoding circuit, 33 sub-band dividing circuit, 34 feature amount calculating circuit, 35 quasi-high frequency sub-band power calculating circuit, 36 number-of-sections determining feature amount calculating circuit, 37 quasi-high frequency sub-band power difference calculating circuit, 38 high frequency encoding circuit, 39 multiplexing circuit, 51 determining unit, 52 evaluation value calculating unit, 53 selecting unit, 54 generating unit

The invention claimed is:

1. An encoding device, comprising:

processing circuitry configured to perform a process including:

receiving an input audio signal;

generating a low frequency sub-band signal of a sub-band on a low frequency side of the input audio signal and a high frequency sub-band signal of a sub-band on a high frequency side of the input audio signal;

calculating a quasi-high frequency sub-band power that is an estimated value of a high frequency sub-band power of the high frequency sub-band signal based on the low frequency sub-band signal and a predetermined estimation coefficient;

calculating a number-of-sections determining feature amount by calculating a sub-band power sum of the power of the sub-band signal of the sub-bands on the high frequency side of the input signal, wherein the sub-band power sum is an estimated bandwidth of a frame to be processed;

determining the number of continuous frame sections including frames for which the same estimation coefficient is selected in a process target section including a plurality of frames of the input signal, based on the number-of-sections determining feature amount;

selecting the estimation coefficient of a frame that constitutes the continuous frame section from a plurality of estimation coefficients based on the quasi-high frequency sub-band power and the high frequency sub-band power in each continuous frame section obtained by dividing the process target section based on the determined number of continuous frame sections;

generating data for obtaining the estimation coefficient selected in a frame of each of the continuous frame sections constituting the process target section;

encoding a low frequency signal of the input signal to generate low frequency encoded data;

multiplexing the data and the low frequency encoded data to generate an output code string representative of the input audio signal; and outputting the output code string.

2. The encoding device according to claim 1, wherein the number-of-sections determining feature amount includes a feature amount indicating a temporal change of a sum of the high frequency sub-band power.

3. The encoding device according to claim 1, wherein the number-of-sections determining feature amount includes a feature amount indicating a frequency profile of the input signal.

4. The encoding device according to claim 1, wherein the number-of-sections determining feature amount includes a linear sum or a nonlinear sum of a plurality of feature amounts.

5. The encoding device according to claim 1, further comprising the processing circuitry calculating, based on an evaluation value indicating an error between the quasi-high frequency sub-band power and the high frequency sub-band power in the frame calculated for each of the estimation coefficients, a sum of the evaluation value of each frame constituting the continuous frame section for each of the estimation coefficients, wherein the selecting includes selecting the estimation coefficient of the frame of the continuous frame section based on the sum of the evaluation value calculated for each of the estimation coefficients.

6. The encoding device according to claim 5, wherein each section obtained by equally dividing the process target section by the determined number of continuous frame sections is defined as the continuous frame section.

7. The encoding device according to claim 5, wherein the selecting includes selecting the estimation coefficient of the frame of the continuous frame section based on the sum of the evaluation value for each combination of divisions of the process target section that can be taken when dividing the process target section by the determined number of continuous frame sections, identifying a combination with which the sum of the evaluation values of the selected estimation coefficients of all the frames constituting the process target section is minimized from among the combinations, and defining the estimation coefficient selected in each frame as the estimation coefficient of the corresponding frame in the identified combination.

8. The encoding device according to claim 1, further comprising the processing circuitry encoding the data to generate high frequency encoded data, wherein the multiplexing includes generating the output code string by multiplexing the high frequency encoded data and the low frequency encoded data.

9. The encoding device according to claim 8, wherein the determining includes calculating an encoding amount of the high frequency encoded data of the process target section based on the determined number of continuous frame sections, and the low frequency encoding includes encoding the low frequency signal with an encoding amount determined from an encoding amount determined in advance for the process target section and the calculated encoding amount of the high frequency encoded data.

10. An encoding method, comprising:

receiving, by processing circuitry, an input audio signal;

generating, by the processing circuitry, a low frequency sub-band signal of a sub-band on a low frequency side of the input audio signal and a high frequency sub-band signal of a sub-band on a high frequency side of the input audio signal;

calculating, by the processing circuitry, a quasi-high frequency sub-band power that is an estimated value of a high frequency sub-band power of the high frequency sub-band signal based on the low frequency sub-band signal and a predetermined estimation coefficient;

calculating, by the processing circuitry, a number-of-sections determining feature amount by calculating a sub-band power sum of the power of the sub-band signal of the sub-bands on the high frequency side of the input signal, wherein the sub-band power sum is an estimated bandwidth of a frame to be processed;

determining, by the processing circuitry, the number of continuous frame sections including frames for which the same estimation coefficient is selected in a process target section including a plurality of frames of the input signal, based on the number-of-sections determining feature amount;

selecting, by the processing circuitry, the estimation coefficient of a frame that constitutes the continuous frame section from a plurality of estimation coefficients based on the quasi-high frequency sub-band power and the high frequency sub-band power in each continuous frame section obtained by dividing the process target section based on the determined number of continuous frame sections;

generating, by the processing circuitry, data for obtaining the estimation coefficient selected in a frame of each of the continuous frame sections constituting the process target section;

generating, by the processing circuitry, low frequency encoded data by encoding a low frequency signal of the input signal;

generating, by the processing circuitry, an output code string by multiplexing the data and the low frequency encoded data, the output code string being representative of the input audio signal; and outputting, by the processing circuitry, the output code string.

11. A computer-readable storage device encoded with computer-executable instructions that, when executed by processing circuitry, perform an encoding method comprising:

receiving an input audio signal;

generating a low frequency sub-band signal of a sub-band on a low frequency side of the input audio signal and a high frequency sub-band signal of a sub-band on a high frequency side of the input audio signal;

calculating a quasi-high frequency sub-band power that is an estimated value of a high frequency sub-band power of the high frequency sub-band signal based on the low frequency sub-band signal and a predetermined estimation coefficient;

calculating a number-of-sections determining feature amount by calculating a sub-band power sum of the power of the sub-band signal of the sub-bands on the high frequency side of the input signal, wherein the sub-band power sum is an estimated bandwidth of a frame to be processed;

determining the number of continuous frame sections including frames for which the same estimation coefficient is selected in a process target section including a plurality of frames of the input signal, based on the number-of-sections determining feature amount;

selecting the estimation coefficient of a frame that constitutes the continuous frame section from a plurality of estimation coefficients based on the quasi-high frequency sub-band power and the high frequency sub-band power in each continuous frame section obtained by dividing the process target section based on the determined number of continuous frame sections;

generating data for obtaining the estimation coefficient selected in a frame of each of the continuous frame sections constituting the process target section;

generating low frequency encoded data by encoding a low frequency signal of the input signal;

generating an output code string by multiplexing the data and the low frequency encoded data, the output code string being representative of the input audio signal; and outputting the output code string.

12. A decoding device, comprising:

processing circuitry configured to perform a process including:

receiving an input code string representative of an audio signal;

demultiplexing the input code string into data for obtaining an estimation coefficient selected in a frame of each continuous frame section constituting a process target section, which is generated based on a result of calculating an estimated value of a high frequency sub-band power of a high frequency sub-band signal of the audio signal based on a low frequency sub-band signal of the audio signal and a predetermined estimation coefficient, determining the number of continuous frame sections including frames for which the same estimation coefficient is selected in the process target section including a plurality of frames of the audio signal based on a number-of-sections determining feature amount extracted from the audio signal, wherein the number-of-sections determining feature amount is calculated by calculating a sub-band power sum of the power of the sub-band signal of the sub-bands on the high frequency side of the input signal, wherein the sub-band power sum is an estimated bandwidth of a frame to be processed, and selecting the estimation coefficient of a frame constituting the continuous frame section from a plurality of estimation coefficients based on the estimated value and the high frequency sub-band power in each of the continuous frame sections obtained by dividing the process target section based on the determined number of continuous frame sections, and low frequency encoded data obtained by encoding a low frequency signal of the input signal;

decoding the low frequency encoded data to generate a low frequency signal;

generating a high frequency signal based on the estimation coefficient obtained from the data and the low frequency signal obtained from the decoding;

generating the audio signal based on the high frequency signal and the low frequency signal obtained from the decoding; and outputting the audio signal.

13. The decoding device according to claim 12, further comprising the processing circuitry decoding the data to obtain the estimation coefficient.

14. The decoding device according to claim 13, wherein based on an evaluation value indicating an error between the estimated value and the high frequency sub-band power in the frame calculated for each of the estimation coefficients, a sum of the evaluation value of each frame constituting the continuous frame section is calculated for each of the estimation coefficients, and based on the sum of the evaluation value calculated for each of the estimation coefficients, the estimation coefficient of the frame of the continuous frame section is selected.

15. The decoding device according to claim 14, wherein each section obtained by equally dividing the process target section by the determined number of continuous frame sections is defined as the continuous frame section.

16. The decoding device according to claim 14, wherein the estimation coefficient of the frame of the continuous frame section is selected based on the sum of the evaluation value for each combination of divisions of the process target section that can be taken when dividing the process target section by the determined number of continuous frame sections, a combination with which the sum of the evaluation values of the selected estimation coefficients of all the frames constituting the process target section is minimized is identified from among the combinations, and the estimation coefficient selected in each frame is defined as the estimation coefficient of the corresponding frame in the identified combination.

17. A decoding method, comprising:

receiving, by processing circuitry, an input code string representative of an audio signal;

demultiplexing, by the processing circuitry, the input code string into data for obtaining an estimation coefficient selected in a frame of each continuous frame section constituting a process target section, which is generated based on a result of calculating an estimated value of a high frequency sub-band power of a high frequency sub-band signal of the audio signal based on a low frequency sub-band signal of the audio signal and a predetermined estimation coefficient, determining the number of continuous frame sections including frames for which the same estimation coefficient is selected in the process target section including a plurality of frames of the audio signal based on a number-of-sections determining feature amount extracted from the audio signal, wherein the number-of-sections determining feature amount is calculated by calculating a sub-band power sum of the power of the sub-band signal of the sub-bands on the high frequency side of the input signal, wherein the sub-band power sum is an estimated bandwidth of a frame to be processed, and selecting the estimation coefficient of a frame constituting the continuous frame section from a plurality of estimation coefficients based on the estimated value and the high frequency sub-band power in each of the continuous frame sections obtained by dividing the process target section based on the determined number of continuous frame sections, and low frequency encoded data obtained by encoding a low frequency signal of the input signal;

generating, by the processing circuitry, a low frequency signal by decoding the low frequency encoded data;

generating, by the processing circuitry, a high frequency signal based on the estimation coefficient obtained from the data and the low frequency signal obtained from the decoding;

generating, by the processing circuitry, the audio signal based on the high frequency signal and the low frequency signal obtained from the decoding; and outputting, by the processing circuitry, the audio signal.

18. A computer-readable storage device encoded with computer-executable instructions that, when executed by processing circuitry, perform an encoding method comprising:

receiving an input code string representative of an audio signal;

demultiplexing the input code string into data for obtaining an estimation coefficient selected in a frame of each continuous frame section constituting a process target section, which is generated based on a result of calculating an estimated value of a high frequency sub-band power of a high frequency sub-band signal of the audio signal based on a low frequency sub-band signal of the audio signal and a predetermined estimation coefficient, determining the number of continuous frame sections including frames for which the same estimation coefficient is selected in the process target section including a plurality of frames of the audio signal based on a number-of-sections determining feature amount extracted from the audio signal, wherein the number-of-sections determining feature amount is calculated by calculating a sub-band power sum of the power of the sub-band signal of the sub-bands on the high frequency side of the input signal, wherein the sub-band power sum is an estimated bandwidth of a frame to be processed, and selecting the estimation coefficient of a frame constituting the continuous frame section from a plurality of estimation coefficients based on the estimated value and the high frequency sub-band power in each of the continuous frame sections obtained by dividing the process target section based on the determined number of continuous frame sections, and low frequency encoded data obtained by encoding a low frequency signal of the input signal;

generating a low frequency signal by decoding the low frequency encoded data;

generating a high frequency signal based on the estimation coefficient obtained from the data and the low frequency signal obtained from the decoding;

generating the audio signal based on the high frequency signal and the low frequency signal obtained from the decoding; and outputting the audio signal.

* * * * *